US011937651B1

(12) United States Patent
Munoz-Guzman et al.

(10) Patent No.: US 11,937,651 B1
(45) **Date of Patent: *Mar. 26, 2024**

(54) REDUCED-COVERAGE BACK-SMOOTHING BRASSIERE

(71) Applicant: Torrid LLC, City of Industry, CA (US)

(72) Inventors: Elizabeth Munoz-Guzman, Arcadia, CA (US); Vince Lacambra, Eastvale, CA (US)

(73) Assignee: Torrid LLC, City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/139,120

(22) Filed: Apr. 25, 2023

Related U.S. Application Data

(63) Continuation of application No. 16/538,749, filed on Aug. 12, 2019, now Pat. No. 11,632,990.

(60) Provisional application No. 62/717,667, filed on Aug. 10, 2018.

(51) Int. Cl.
*A41C 3/12* (2006.01)
*A41C 5/00* (2006.01)

(52) U.S. Cl.
CPC . *A41C 3/12* (2013.01); *A41C 5/00* (2013.01)

(58) Field of Classification Search
CPC ..... A41B 2400/38
See application file for complete search history.

(56) References Cited

U.S. PATENT DOCUMENTS

| | | | |
|---|---|---|---|
| 2,638,596 | A | 5/1953 | Fridolph |
| 3,144,869 | A | 8/1964 | Blair |
| 3,157,182 | A | 11/1964 | Fridolph |
| 3,220,415 | A | 11/1965 | Marino |
| 4,187,855 | A | 2/1980 | Paulus et al. |
| 5,211,598 | A | 5/1993 | Hall |
| 6,180,178 | B1 | 1/2001 | Vogt |
| 6,551,171 | B1 | 4/2003 | Hass et al. |
| 8,480,452 | B2 | 7/2013 | Reinisch et al. |
| 9,730,475 | B1 | 8/2017 | Tomkoria |
| 9,883,702 | B2 | 2/2018 | Martinet et al. |
| 2006/0057935 | A1 | 3/2006 | Hung et al. |
| 2007/0082579 | A1 | 4/2007 | Baran et al. |

(Continued)

FOREIGN PATENT DOCUMENTS

| | | |
|---|---|---|
| CN | 204070608 U | 1/2015 |

OTHER PUBLICATIONS

International Application No. PCT/US2019/046239, International Search Report and Written Opinion, dated Oct. 17, 2019, 9 pages.

*Primary Examiner* — Jocelyn Bravo
(74) *Attorney, Agent, or Firm* — Sheppard, Mullin, Richter & Hampton LLP

(57) ABSTRACT

An example reduced-coverage back-smoothing brassiere includes a right and left brassiere cup, right and left brassiere wings, each coupled to at least a portion of one of the two brassiere cups and one of two brassiere straps, first edges of the brassiere wings each being a continuous curve leading to the exterior edge of the respective brassiere wing, the second portion of the right brassiere strap being coupled to the right brassiere cup and the second portion of the left brassiere strap being coupled to the left brassiere cup, a second edge of each of the brassiere wings extending in an unbroken curve from the respective brassiere strap toward the fastening section, a continuous, unbroken curve being created by the interior edge of each of the two brassiere straps along the second edge of each of the two brassiere wings, respectively.

3 Claims, 24 Drawing Sheets

(56) References Cited

U.S. PATENT DOCUMENTS

| | | | |
|---|---|---|---|
| 2009/0181599 | A1 | 7/2009 | Farmer et al. |
| 2009/0197508 | A1 | 8/2009 | Getz |
| 2009/0233524 | A1 | 9/2009 | Cohen |
| 2009/0270012 | A1 | 10/2009 | Melarti et al. |
| 2010/0124869 | A1 | 5/2010 | Liu |
| 2012/0196508 | A1 | 8/2012 | Anvaripour |
| 2014/0170934 | A1 | 6/2014 | Palav |
| 2016/0044972 | A1 | 2/2016 | Yuasa et al. |
| 2017/0099884 | A1 | 4/2017 | Martinet et al. |
| 2017/0105458 | A1 | 4/2017 | McBride |
| 2017/0226691 | A1 | 8/2017 | Farmer et al. |

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000028964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | | | | | | | | | | | |
|---|---|---|---|---|---|---|---|---|---|---|---|---|---|---|---|
| | | | | Size Code | 36C | 36D | 36DD | 36DDD | 38B | 38C | 38D | 38DD |
| | | | | Active Size | Yes | Yes | Yes | Yes | Yes | Yes | Yes | Yes |
| | | | | Sample Size | No | No | No | No | No | No | No | Yes |
| **POM Code** | **POM Description** | **TOL (-)** | **TOL (+)** | | | | | | | | | |
| B001 | A- NECKLINE (FT STRAP PLATFORM TO CF, INC WIRE) | -1/4 | 1/4 | Grading | -9/16 | -3/8 | -3/16 | 0 | -9/16 | -3/8 | -3/16 | 0 |
| | | | | Spec Meas | 8 15/16 | 9 1/8 | 9 5/16 | 9 1/2 | 8 15/16 | 9 1/8 | 9 5/16 | 9 1/2 |
| B002 | B-UNDERARM (FT STRAP PLATFORM TO CUP/ WING SEAM, INC WRE) | -1/4 | 1/4 | Grading | -3/4 | -1/2 | -1/4 | 0 | -3/4 | -1/2 | -1/4 | 0 |
| | | | | Spec Meas | 4 1/8 | 4 3/8 | 4 5/8 | 4 7/8 | 4 1/8 | 4 3/8 | 4 5/8 | 4 7/8 |
| B003 | C-WIRE CHANNEL (EDGE TO EDGE ALONG OUTSIDE STITCH) | -1/4 | 1/4 | Grading | -1 7/8 | -1 1/4 | -5/8 | 0 | -1 7/8 | -1 1/4 | -5/8 | 0 |
| | | | | Spec Meas | 8 1/8 | 8 3/4 | 9 3/8 | 10 | 8 1/8 | 8 3/4 | 9 3/8 | 10 |
| B004 | D-WIRE PLAY (WIRE PUSHED TO FT. EDGE OF WIRE TO BTM OF U/ARM TACK) | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | 0 | 0 | 0 | 0 | 0 | 0 | 0 | 0 |
| | | | | Spec Meas | 9 1/2 | 9 1/2 | 9 1/2 | 9 1/2 | 9 1/2 | 9 1/2 | 9 1/2 | 9 1/2 |
| B006 | F - TOP BACK (FM CUP/WING SEAM TO 1ST EYE, EXCL WIRE) | -1/4 | 1/4 | Grading | 1/8 | -1/4 | -5/8 | -1 | 1 1/8 | 3/4 | 3/8 | 0 |
| | | | | Spec Meas | 8 9/16 | 8 3/16 | 7 13/16 | 7 7/16 | 9 9/16 | 9 3/16 | 8 13/16 | 8 7/16 |
| B007 | G - BOTTOM BACK (FM H/UP TO 1ST EYE) | -1/4 | 1/4 | Grading | -1/4 | -1/2 | -3/4 | -1 | 3/4 | 1/2 | 1/4 | 0 |
| | | | | Spec Meas | 10 1/16 | 9 13/16 | 9 9/16 | 9 5/16 | 11 1/16 | 10 13/16 | 10 9/16 | 10 5/16 |
| B008 | H - TOP CF (STRAIGHT ACROSS, EXCL WIRE) | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B009 | I - BTM CF (ALONG CURVE) | -1/8 | 1/8 | Grading | 0 | 0 | 0 | 0 | 0 | 0 | 0 | 0 |
| | | | | Spec Meas | 2 7/16 | 2 7/16 | 2 7/16 | 2 7/16 | 2 7/16 | 2 7/16 | 2 7/16 | 2 7/16 |
| B010 | J - TTL BOTTOM BAND (FM 1ST HOOK TO EYE) | -1/2 | 1/2 | Grading | -2 | -2 | -2 | -2 | 0 | 0 | 0 | 0 |
| | | | | Spec Meas | 27 | 27 | 27 | 27 | 29 | 29 | 29 | 29 |
| B011 | K - CF HEIGHT (EDGE TO EDGE OF LINING) | -1/8 | 1/8 | Grading | -3/8 | -1/4 | -1/8 | 0 | -3/8 | -1/4 | -1/8 | 0 |
| | | | | Spec Meas | 11/16 | 13/16 | 15/16 | 1 1/16 | 11/16 | 13/16 | 15/16 | 1 1/16 |
| B012 | L - CB HEIGHT (EDGE TO EDGE) | -1/8 | 1/8 | Grading | 0 | 0 | 0 | 0 | 0 | 0 | 0 | 0 |
| | | | | Spec Meas | 2 1/4 | 2 1/4 | 2 1/4 | 2 1/4 | 2 1/4 | 2 1/4 | 2 1/4 | 2 1/4 |
| GEN001 | M - CB NECKLINE (INSIDE EDGE OF TAB TO 1ST HOOK/ EYE) | -1/8 | 1/8 | Grading | -3/8 | -1/4 | -1/8 | 0 | -3/8 | -1/4 | -1/8 | 0 |
| | | | | Spec Meas | 5 3/4 | 5 7/8 | 6 | 6 1/8 | 5 3/4 | 5 7/8 | 6 | 6 1/8 |

FIG. 10A

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000028964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | | | | | | | | | |
|---|---|---|---|---|---|---|---|---|---|---|---|---|---|
| | | | | Size Code | 38DDD | 38F | 38G | 38H | 40B | 40C | 40D | 40DD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A- NECKLINE (FT STRAP PLATFORM TO CF, INC WIRE) | -1/4 | 1/4 | Grading | 3/16 | -1/4 | -1/8 | 0 | -3/8 | -3/16 | 0 | 3/16 |
| | | | | Spec Meas | 9 11/16 | 9 1/4 | 9 3/8 | 9 1/2 | 9 1/8 | 9 5/16 | 9 1/2 | 9 11/16 |
| B002 | B-UNDERARM (FT STRAP PLATFORM TO CUP/ WING SEAM, INC WRE) | -1/4 | 1/4 | Grading | 1/4 | -3/4 | -5/8 | -1/2 | -1/2 | -1/4 | 0 | 1/4 |
| | | | | Spec Meas | 5 1/8 | 4 1/8 | 4 1/4 | 4 3/8 | 4 3/8 | 4 5/8 | 4 7/8 | 5 1/8 |
| B003 | C-WIRE CHANNEL (EDGE TO EDGE ALONG OUTSIDE STITCH) | -1/4 | 1/4 | Grading | 5/8 | 2 | 2 5/8 | 3 1/4 | -1 1/4 | -5/8 | 0 | 5/8 |
| | | | | Spec Meas | 10 5/8 | 12 | 12 5/8 | 13 1/4 | 8 3/4 | 9 3/8 | 10 | 10 5/8 |
| B004 | D-WIRE PLAY (WIRE PUSHED TO FT. EDGE OF WIRE TO BTM OF U/ARM TACK) | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | 0 | -1 | -1 | -1 | 0 | 0 | 0 | 0 |
| | | | | Spec Meas | 9 1/2 | 8 1/2 | 8 1/2 | 8 1/2 | 9 1/2 | 9 1/2 | 9 1/2 | 9 1/2 |
| B006 | F - TOP BACK (FM CUP/WING SEAM TO 1ST EYE, EXCL WIRE) | -1/4 | 1/4 | Grading | -3/8 | -5/8 | -1 | -1 3/8 | 1 3/4 | 1 3/8 | 1 | 5/8 |
| | | | | Spec Meas | 8 1/16 | 7 13/16 | 7 7/16 | 7 1/16 | 10 3/16 | 9 13/16 | 9 7/16 | 9 1/16 |
| B007 | G - BOTTOM BACK (FM H/UP TO 1ST EYE) | -1/4 | 1/4 | Grading | -1/4 | 0 | -1/4 | -1/2 | 1 1/2 | 1 1/4 | 1 | 3/4 |
| | | | | Spec Meas | 10 1/16 | 10 5/16 | 10 1/16 | 9 13/16 | 11 13/16 | 11 9/16 | 11 5/16 | 11 1/16 |
| B008 | H - TOP CF (STRAIGHT ACROSS, EXCL WIRE) | -1/8 | 1/8 | Grading | 0 | -1/8 | -1/8 | -1/8 | 0 | 0 | 0 | 0 |
| | | | | Spec Meas | 1/4 | 1/8 | 1/8 | 1/8 | 1/4 | 1/4 | 1/4 | 1/4 |
| B009 | I - BTM CF (ALONG CURVE) | -1/8 | 1/8 | Grading | 0 | -1/16 | -1/16 | -1/16 | 0 | 0 | 0 | 0 |
| | | | | Spec Meas | 2 7/16 | 2 3/8 | 2 3/8 | 2 3/8 | 2 7/16 | 2 7/16 | 2 7/16 | 2 7/16 |
| B010 | J - TTL BOTTOM BAND (FM 1ST HOOK TO EYE) | -1/2 | 1/2 | Grading | 0 | 0 | 0 | 0 | 2 | 2 | 2 | 2 |
| | | | | Spec Meas | 29 | 29 | 29 | 29 | 31 | 31 | 31 | 31 |
| B011 | K - CF HEIGHT (EDGE TO EDGE OF LINING) | -1/8 | 1/8 | Grading | 1/8 | 3/16 | 5/16 | 7/16 | -1/4 | -1/8 | 0 | 1/8 |
| | | | | Spec Meas | 1 3/16 | 1 1/4 | 1 3/8 | 1 1/2 | 1 3/16 | 1 5/16 | 1 1/16 | 1 3/16 |
| B012 | L - CB HEIGHT (EDGE TO EDGE) | -1/8 | 1/8 | Grading | 0 | 1 1/2 | 1 1/2 | 1 1/2 | 0 | 0 | 0 | 0 |
| | | | | Spec Meas | 2 1/4 | 3 3/4 | 3 3/4 | 3 3/4 | 2 1/4 | 2 1/4 | 2 1/4 | 2 1/4 |
| GEN001 | M - CB NECKLINE (INSIDE EDGE OF TAB TO 1ST HOOK/ EYE) | -1/8 | 1/8 | Grading | 1/8 | -3/8 | -1/4 | -1/8 | -1/4 | -1/8 | 0 | 1/8 |
| | | | | Spec Meas | 6 1/4 | 5 3/4 | 5 7/8 | 6 | 5 3/4 | 6 | 6 1/8 | 6 1/4 |

FIG. 10B

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000028964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | | | | | | | | | |
|---|---|---|---|---|---|---|---|---|---|---|---|---|---|
| | | | | Size Code | 40DDD | 40F | 40G | 40H | 42B | 42C | 42D | 42DD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A- NECKLINE (FT STRAP PLATFORM TO CF, INC WIRE) | -1/4 | 1/4 | Grading | 3/8 | -1/8 | 0 | 1/8 | -3/16 | 0 | 3/16 | 3/8 |
| | | | | Spec Meas | 9 7/8 | 9 3/8 | 9 1/2 | 9 5/8 | 9 5/16 | 9 1/2 | 9 11/16 | 9 7/8 |
| B002 | B-UNDERARM (FT STRAP PLATFORM TO CUP/ WING SEAM, INC WRE) | -1/4 | 1/4 | Grading | 1/2 | -5/8 | -1/2 | -3/8 | -1/4 | 0 | 1/4 | 1/2 |
| | | | | Spec Meas | 5 3/8 | 4 1/4 | 4 3/8 | 4 1/2 | 4 5/8 | 4 7/8 | 5 1/8 | 5 3/8 |
| B003 | C-WIRE CHANNEL (EDGE TO EDGE ALONG OUTSIDE STITCH) | -1/4 | 1/4 | Grading | 1 1/4 | 2 5/8 | 3 1/4 | 3 7/8 | -5/8 | 0 | 5/8 | 1 1/4 |
| | | | | Spec Meas | 11 1/4 | 12 5/8 | 13 1/4 | 13 7/8 | 9 3/8 | 10 | 10 5/8 | 11 1/4 |
| B004 | D-WIRE PLAY (WIRE PUSHED TO FT. EDGE OF WIRE TO BTM OF U/ARM TACK) | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | -1 | -1 | -1 | -1 | 0 | 0 | 0 | -1 |
| | | | | Spec Meas | 8 1/2 | 8 1/2 | 8 1/2 | 8 1/2 | 9 1/2 | 9 1/2 | 9 1/2 | 8 1/2 |
| B006 | F - TOP BACK (FM CUP/WING SEAM TO 1ST EYE, EXCL WIRE) | -1/4 | 1/4 | Grading | 1/4 | 0 | -3/8 | -3/4 | 2 3/8 | 2 | 1 5/8 | 1 1/4 |
| | | | | Spec Meas | 8 11/16 | 8 7/16 | 8 1/16 | 7 11/16 | 10 13/16 | 10 7/16 | 10 1/16 | 9 11/16 |
| B007 | G - BOTTOM BACK (FM H/UP TO 1ST EYE) | -1/4 | 1/4 | Grading | 1/2 | 3/4 | 1/2 | 1/4 | 2 1/4 | 2 | 1 3/4 | 1 1/2 |
| | | | | Spec Meas | 10 13/16 | 11 1/16 | 10 13/16 | 10 9/16 | 12 9/16 | 12 5/16 | 12 1/16 | 11 13/16 |
| B008 | H - TOP CF (STRAIGHT ACROSS, EXCL WIRE) | -1/8 | 1/8 | Grading | 0 | -1/8 | -1/8 | -1/8 | 0 | 0 | 0 | 0 |
| | | | | Spec Meas | 1/4 | 1/8 | 1/8 | 1/8 | 1/4 | 1/4 | 1/4 | 1/4 |
| B009 | I - BTM CF (ALONG CURVE) | -1/8 | 1/8 | Grading | 0 | -1/16 | -1/16 | -1/16 | 0 | 0 | 0 | 0 |
| | | | | Spec Meas | 2 7/16 | 2 3/8 | 2 3/8 | 2 3/8 | 2 7/16 | 2 7/16 | 2 7/16 | 2 7/16 |
| B010 | J - TTL BOTTOM BAND (FM 1ST HOOK TO EYE) | -1/2 | 1/2 | Grading | 2 | 2 | 2 | 2 | 4 | 4 | 4 | 4 |
| | | | | Spec Meas | 31 | 31 | 31 | 31 | 33 | 33 | 33 | 33 |
| B011 | K - CF HEIGHT (EDGE TO EDGE OF LINING) | -1/8 | 1/8 | Grading | 1/4 | 5/16 | 7/16 | 9/16 | -1/8 | 0 | 1/8 | 1/4 |
| | | | | Spec Meas | 1 5/16 | 1 3/8 | 1 1/2 | 1 5/8 | 1 5/16 | 1 1/16 | 1 3/16 | 1 5/16 |
| B012 | L - CB HEIGHT (EDGE TO EDGE) | -1/8 | 1/8 | Grading | 3/4 | 1 1/2 | 1 1/2 | 1 1/2 | 0 | 0 | 0 | 3/4 |
| | | | | Spec Meas | 3 | 3 3/4 | 3 3/4 | 3 3/4 | 2 1/4 | 2 1/4 | 2 1/4 | 3 |
| GEN001 | M - CB NECKLINE (INSIDE EDGE OF TAB TO 1ST HOOK/ EYE) | -1/8 | 1/8 | Grading | -1/2 | -1/4 | -1/8 | 0 | -1/8 | 0 | 1/8 | -1/2 |
| | | | | Spec Meas | 5 5/8 | 5 7/8 | 6 | 6 1/8 | 6 | 6 1/8 | 6 1/4 | 5 5/8 |

FIG. 10C

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000023964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | Size Code | 42DDD | 42F | 42G | 42H | 44B | 44C | 44D | 44DD |
|---|---|---|---|---|---|---|---|---|---|---|---|---|---|
| | | | | | Active Size | Yes | Yes | Yes | Yes | Yes | Yes | Yes | Yes |
| | | | | | Sample Size | No | No | No | No | No | No | No | No |
| **POM Code** | **POM Description** | **TOL (-)** | **TOL (+)** | | | | | | | | | | |
| B001 | A - NECKLINE (FT STRAP PLATFORM TO CF, INC WIRE) | -1/4 | 1/4 | Grading | 9/16 | 0 | 1/8 | 1/4 | 0 | 3/16 | 3/8 | 9/16 |
| | | | | Spec Meas | 10 1/16 | 9 1/2 | 9 5/8 | 9 3/4 | 9 1/2 | 9 11/16 | 9 7/8 | 10 1/16 |
| B002 | B - UNDERARM (FT STRAP PLATFORM TO CUP/ WING SEAM, INC WIRE) | -1/4 | 1/4 | Grading | 3/4 | -1/2 | -3/8 | -1/4 | 0 | 1/4 | 1/2 | 3/4 |
| | | | | Spec Meas | 5 5/6 | 4 3/8 | 4 1/2 | 4 5/8 | 4 7/8 | 5 1/8 | 5 3/8 | 5 5/8 |
| B003 | C - WIRE CHANNEL (EDGE TO EDGE ALONG OUTSIDE STITCH) | -1/4 | 1/4 | Grading | 1 7/8 | 3 1/4 | 3 7/8 | 4 1/2 | 0 | 5/8 | 1 1/4 | 1 7/8 |
| | | | | Spec Meas | 11 7/8 | 13 1/4 | 13 7/8 | 14 1/2 | 10 | 10 5/8 | 11 1/4 | 11 7/8 |
| B004 | D - WIRE PLAY (WIRE PUSHED TO FT. EDGE OF WIRE TO BTM OF U/ARM TACK) | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | -1 | -1 | -1 | -1 | 0 | 0 | -1 | -1 |
| | | | | Spec Meas | 8 1/2 | 8 1/2 | 8 1/2 | 8 1/2 | 9 1/2 | 9 1/2 | 8 1/2 | 8 1/2 |
| B006 | F - TOP BACK (FM CUP/WING SEAM TO 1ST EYE, EXCL WIRE) | -1/4 | 1/4 | Grading | 7/8 | 5/8 | 1/4 | -1/8 | 3 | 2 5/8 | 2 1/4 | 1 7/8 |
| | | | | Spec Meas | 9 5/16 | 9 1/16 | 8 11/16 | 8 5/16 | 11 7/16 | 11 1/16 | 10 11/16 | 10 5/16 |
| B007 | G - BOTTOM BACK (FM H/UP TO 1ST EYE) | -1/4 | 1/4 | Grading | 1 1/4 | 1 1/2 | 1 1/4 | 1 | 3 | 2 3/4 | 2 1/2 | 2 1/4 |
| | | | | Spec Meas | 11 9/16 | 11 13/16 | 11 9/16 | 11 5/16 | 13 5/16 | 13 1/16 | 12 13/16 | 12 9/16 |
| B008 | H - TOP CF (STRAIGHT ACROSS, EXCL WIRE) | -1/8 | 1/8 | Grading | 0 | -1/8 | -1/8 | -1/8 | 0 | 0 | 0 | 0 |
| | | | | Spec Meas | 1/4 | 1/8 | 1/8 | 1/8 | 1/4 | 1/4 | 1/4 | 1/4 |
| B009 | I - BTM CF (ALONG CURVE) | -1/8 | 1/8 | Grading | 0 | -1/16 | -1/16 | -1/16 | 0 | 0 | 0 | 0 |
| | | | | Spec Meas | 2 7/16 | 2 3/8 | 2 3/8 | 2 3/8 | 2 7/16 | 2 7/16 | 2 7/16 | 2 7/16 |
| B010 | J - TTL BOTTOM BAND (FM 1ST HOOK TO EYE) | -1/2 | 1/2 | Grading | 4 | 4 | 4 | 4 | 6 | 6 | 6 | 6 |
| | | | | Spec Meas | 33 | 33 | 33 | 33 | 35 | 35 | 35 | 35 |
| B011 | K - CF HEIGHT (EDGE TO EDGE OF LINING) | -1/8 | 1/8 | Grading | 3/8 | 7/16 | 9/16 | 11/16 | 0 | 1/8 | 1/4 | 3/8 |
| | | | | Spec Meas | 1 7/16 | 1 1/2 | 1 5/8 | 1 3/4 | 1 1/16 | 1 3/16 | 1 5/16 | 1 7/16 |
| B012 | L - CB HEIGHT (EDGE TO EDGE) | -1/8 | 1/8 | Grading | 3/4 | 1 1/2 | 1 1/2 | 1 1/2 | 0 | 0 | 3/4 | 3/4 |
| | | | | Spec Meas | 3 | 3 3/4 | 3 3/4 | 3 3/4 | 2 1/4 | 2 1/4 | 3 | 3 |
| GEN001 | M - CB NECKLINE (INSIDE EDGE OF TAB TO 1ST HOOK/EYE) | -1/8 | 1/8 | Grading | -3/8 | -1/8 | 0 | 1/8 | 0 | 1/8 | -1/2 | -3/8 |
| | | | | Spec Meas | 5 3/4 | 6 | 6 1/8 | 6 1/4 | 6 1/8 | 6 1/4 | 5 5/8 | 5 3/4 |

FIG. 10D

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000023964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | | | | | | | | | | | | | |
|---|---|---|---|---|---|---|---|---|---|---|---|---|---|---|---|---|---|
| | | | | Size Code | 44DDD | 44F | 44G | 46B | 46C | 46D | 46DD | 46DDD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (FT STRAP PLATFORM TO CF, INC WIRE) | -1/4 | 1/4 | Grading | 3/4 | 1/8 | 1/4 | 3/16 | 3/8 | 9/16 | 3/4 | 15/16 |
| | | | | Spec Meas | 10 1/4 | 9 5/8 | 9 3/4 | 9 11/16 | 9 7/8 | 10 1/16 | 10 1/4 | 10 7/16 |
| B002 | B - UNDERARM (FT STRAP PLATFORM TO CUP/ WING SEAM, INC WIRE) | -1/4 | 1/4 | Grading | 1 | -3/8 | -1/4 | 1/4 | 1/2 | 3/4 | 1 | 1 1/4 |
| | | | | Spec Meas | 5 7/8 | 4 1/2 | 4 5/8 | 5 1/8 | 5 3/8 | 5 5/8 | 5 7/8 | 6 1/8 |
| B003 | C - WIRE CHANNEL (EDGE TO EDGE ALONG OUTSIDE STITCH) | -1/4 | 1/4 | Grading | 2 1/2 | 3 7/8 | 4 1/2 | 5/8 | 1 1/4 | 1 7/8 | 2 1/2 | 3 1/8 |
| | | | | Spec Meas | 12 1/2 | 13 7/8 | 14 1/2 | 10 5/8 | 11 1/4 | 11 7/8 | 12 1/2 | 13 1/8 |
| B004 | D - WIRE PLAY (WIRE PUSHED TO FT. EDGE OF WIRE TO BTM OF U/ARM TACK) | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | -1 | -1 | -1 | 0 | -1 | -1 | -1 | -1 |
| | | | | Spec Meas | 8 1/2 | 8 1/2 | 8 1/2 | 9 1/2 | 8 1/2 | 8 1/2 | 8 1/2 | 8 1/2 |
| B006 | F - TOP BACK (FM CUP/WING SEAM TO 1ST EYE, EXCL WIRE) | -1/4 | 1/4 | Grading | 1 1/2 | 1 1/4 | 7/8 | 3 5/8 | 3 1/4 | 2 7/8 | 2 1/2 | 2 1/8 |
| | | | | Spec Meas | 9 15/16 | 9 11/16 | 9 5/16 | 12 1/16 | 11 11/16 | 11 5/16 | 10 15/16 | 10 9/16 |
| B007 | G - BOTTOM BACK (FM H/UP TO 1ST EYE) | -1/4 | 1/4 | Grading | 2 | 2 1/4 | 2 | 3 3/4 | 3 1/2 | 3 1/4 | 3 | 2 3/4 |
| | | | | Spec Meas | 12 5/16 | 12 9/16 | 12 5/16 | 14 1/16 | 13 13/16 | 13 9/16 | 13 5/16 | 13 1/16 |
| B008 | H - TOP CF (STRAIGHT ACROSS, EXCL WIRE) | -1/8 | 1/8 | Grading | 0 | -1/8 | -1/8 | 0 | 0 | 0 | 0 | 0 |
| | | | | Spec Meas | 1/4 | 1/8 | 1/8 | 1/4 | 1/4 | 1/4 | 1/4 | 1/4 |
| B009 | I - BTM CF (ALONG CURVE) | -1/8 | 1/8 | Grading | 0 | -1/16 | -1/16 | 0 | 0 | 0 | 0 | 0 |
| | | | | Spec Meas | 2 7/16 | 2 3/8 | 2 3/8 | 2 7/16 | 2 7/16 | 2 7/16 | 2 7/16 | 2 7/16 |
| B010 | J - TTL BOTTOM BAND (FM 1ST HOOK TO EYE) | -1/2 | 1/2 | Grading | 6 | 6 | 6 | 8 | 8 | 8 | 8 | 8 |
| | | | | Spec Meas | 35 | 35 | 35 | 37 | 37 | 37 | 37 | 37 |
| B011 | K - CF HEIGHT (EDGE TO EDGE OF LINING) | -1/8 | 1/8 | Grading | 1/2 | 9/16 | 11/16 | 1/8 | 1/4 | 3/8 | 1/2 | 5/8 |
| | | | | Spec Meas | 1 9/16 | 1 5/8 | 1 3/4 | 1 3/16 | 1 5/16 | 1 7/16 | 1 9/16 | 1 11/16 |
| B012 | L - CB HEIGHT (EDGE TO EDGE) | -1/8 | 1/8 | Grading | 3/4 | 1 1/2 | 1 1/2 | 0 | 3/4 | 3/4 | 3/4 | 3/4 |
| | | | | Spec Meas | 3 | 3 3/4 | 3 3/4 | 2 1/4 | 3 | 3 | 3 | 3 |
| GEN001 | M - CB NECKLINE (INSIDE EDGE OF TAB TO 1ST HOOK/EYE) | -1/8 | 1/8 | Grading | -1/4 | 0 | 1/8 | 1/8 | -1/2 | -3/8 | -1/4 | -1/8 |
| | | | | Spec Meas | 5 7/8 | 6 1/8 | 6 1/4 | 6 1/4 | 5 5/8 | 5 3/4 | 5 7/8 | 6 |

FIG. 10E

PD Style# 62-28964
360 SMOOTHING PU PLUNGE

Product Development Package
Points of Measure

| | | | | | | | | | |
|---|---|---|---|---|---|---|---|---|---|
| **Brand/Div** | TORRID | **PD Season Year** | TD RESORT | **Designer** | VLACAMBRA | **PD Sourcing Mgr** | MEGHAN QUINN | **Create Date** | 02/28/2017 |
| **Dept** | FOUNDATIONS | **PD Season Code** | RESORT | **Tech Des.** | CROBLES | **Request No** | 0000023964 | **Revised Date** | 07/27/2017 |
| **Prod. Category** | BRAS | **Size** | TD BRAS 36-52 | **Product Mgr** | | **PD Style No/ VSN No** | 62-28964 | **Status** | NEW |

| **Model Name** | BRAS |
|---|---|

| | | | | | | | | | |
|---|---|---|---|---|---|---|---|---|---|
| | | | | Size Code | 48C | 48D | 48DD | 48DDD | 48G |
| | | | | Active Size | Yes | Yes | Yes | Yes | Yes |
| | | | | Sample Size | No | No | No | No | No |
| **POM Code** | **POM Description** | **TOL (-)** | **TOL (+)** | | | | | | |
| B001 | A - NECKLINE (FT STRAP PLATFORM TO CF, INC WIRE) | -1/4 | 1/4 | Grading | 9/16 | 3/4 | 15/16 | 1 1/8 | 1 1/8 |
| | | | | Spec Meas | 10 1/16 | 10 1/4 | 10 7/16 | 10 5/8 | 10 5/8 |
| B002 | B - UNDERARM (FT STRAP PLATFORM TO CUP/ WING SEAM, INC WIRE) | -1/4 | 1/4 | Grading | 3/4 | 1 | 1 1/4 | 1 1/2 | -1/4 |
| | | | | Spec Meas | 5 5/6 | 5 7/8 | 6 1/8 | 6 3/8 | 4 5/8 |
| B003 | C - WIRE CHANNEL (EDGE TO EDGE ALONG OUTSIDE STITCH) | -1/4 | 1/4 | Grading | 1 7/8 | 2 1/2 | 3 1/8 | 3 3/4 | 5 3/4 |
| | | | | Spec Meas | 11 7/8 | 12 1/2 | 13 1/8 | 13 3/4 | 15 3/4 |
| B004 | D - WIRE PLAY (WIRE PUSHED TO FT. EDGE OF WIRE TO BTM OF U/ARM TACK) | -1/8 | 1/8 | Grading | 0 | 0 | 0 | 0 | 0 |
| | | | | Spec Meas | 3/8 | 3/8 | 3/8 | 3/8 | 3/8 |
| B005 | E - STRAP LENGTH (FT STRAP PLTFM TO BK SLIDE INC 2 1/2" ADJUST) | -3/8 | 3/8 | Grading | -1 | -1 | -1 | -1 | -1 |
| | | | | Spec Meas | 8 1/2 | 8 1/2 | 8 1/2 | 8 1/2 | 8 1/2 |
| B006 | F - TOP BACK (FM CUP/WING SEAM TO 1ST EYE, EXCL WIRE) | -1/4 | 1/4 | Grading | 3 7/8 | 3 1/2 | 3 1/8 | 2 3/4 | 2 1/8 |
| | | | | Spec Meas | 12 5/16 | 11 15/16 | 11 9/16 | 11 3/16 | 10 9/16 |
| B007 | G - BOTTOM BACK (FM H/UP TO 1ST EYE) | -1/4 | 1/4 | Grading | 4 1/4 | 4 | 3 3/4 | 3 1/2 | 3 1/2 |
| | | | | Spec Meas | 14 9/16 | 14 5/16 | 14 1/16 | 13 13/16 | 13 13/16 |
| B008 | H - TOP CF (STRAIGHT ACROSS, EXCL WIRE) | -1/8 | 1/8 | Grading | 0 | 0 | 0 | 0 | 1/3 |
| | | | | Spec Meas | 1/4 | 1/4 | 1/4 | 1/4 | 3/8 |
| B009 | I - BTM CF (ALONG CURVE) | -1/8 | 1/8 | Grading | 0 | 0 | 0 | 0 | -1/16 |
| | | | | Spec Meas | 2 7/16 | 2 7/16 | 2 7/16 | 2 7/16 | 2 3/8 |
| B010 | J - TTL BOTTOM BAND (FM 1ST HOOK TO EYE) | -1/2 | 1/2 | Grading | 10 | 10 | 10 | 10 | 10 |
| | | | | Spec Meas | 39 | 39 | 39 | 39 | 39 |
| B011 | K - CF HEIGHT (EDGE TO EDGE OF LINING) | -1/8 | 1/8 | Grading | 3/8 | 1/2 | 5/8 | 3/4 | 15/16 |
| | | | | Spec Meas | 1 7/16 | 1 9/16 | 1 11/16 | 1 13/16 | 2 |
| B012 | L - CB HEIGHT (EDGE TO EDGE) | -1/8 | 1/8 | Grading | 3/4 | 3/4 | 3/4 | 3/4 | 1 1/2 |
| | | | | Spec Meas | 3 | 3 | 3 | 3 | 3 3/4 |
| GEN001 | M - CB NECKLINE (INSIDE EDGE OF TAB TO 1ST HOOK/EYE) | -1/8 | 1/8 | Grading | -3/8 | -1/4 | -1/8 | 0 | 3/8 |
| | | | | Spec Meas | 5 3/4 | 5 7/8 | 6 | 6 1/8 | 6 1/2 |

FIG. 10F

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | | | | | | | | | |
|---|---|---|---|---|---|---|---|---|---|---|---|---|
| | | | | Size Code | 36C | 36D | 36DD | 36DDD | 38B | 38C | 38D | 38DD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP FLATFORM | -1/4 | 1/4 | Grading | -3/8 | -1/4 | -1/8 | 0 | -3/8 | -1/4 | -1/8 | |
| | | | | Spec Meas | 7 5/8 | 7 3/4 | 7 7/8 | 8 | 7 5/8 | 7 3/4 | 7 7/8 | 8 |
| B002 | B - UNDERARM (FROM STRAP PLATFORM TO SEAM EXCL WIRE) | -1/8 | 1/8 | Grading | -1/2 | -1/4 | -1/8 | 0 | -1/2 | -1/4 | -1/8 | |
| | | | | Spec Meas | 4 | 4 1/4 | 4 3/8 | 4 1/2 | 4 | 4 1/4 | 4 3/8 | 4 1/2 |
| B003 | C - WIRE CHANNEL | -1/8 | 1/8 | Grading | -1 7/8 | -1 1/4 | -5/8 | 0 | -1 7/8 | -1 1/4 | -5/8 | |
| | | | | Spec Meas | 9 7/8 | 10 1/2 | 11 1/8 | 11 3/4 | 9 7/8 | 10 1/2 | 11 1/8 | 11 3/4 |
| B004 | D - WIRE PLAY | -1/8 | 1/8 | Grading | 0 | 0 | 0 | 0 | 0 | 0 | 0 | |
| | | | | Spec Meas | 3/8 | 3/8 | 3/8 | 38 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | -5/8 | -7/16 | -1/4 | -1/6 | -9/16 | -3/8 | -3/16 | |
| | | | | Spec Meas | 5 3/4 | 5 15/16 | 6 1/8 | 6 5/6 | 5 13/16 | 6 | 6 3/16 | 6 3/8 |
| B006 | G - TOP BACK (FM CUP/WING SEAM TO STRAP EDGE, ALONG CURVED EDGE) | -1/4 | 1/4 | Grading | 1/4 | -1/8 | -1/2 | -7/8 | 1 1/8 | 3/4 | 3/8 | |
| | | | | Spec Meas | 9 1/8 | 8 3/4 | 8 3/8 | 8 | 10 | 9 5/8 | 9 1/4 | 8 7/8 |
| B008 | H - TOP CF | -1/8 | 1/8 | Grading | 0 | 0 | 0 | 0 | 0 | 0 | 0 | |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE) | -1/2 | 1/2 | Grading | -2 | -2 | -2 | -2 | 0 | 0 | 0 | |
| | | | | Spec Meas | 27 5/6 | 27 5/8 | 27 5/8 | 27 5/8 | 29 5/8 | 29 5/8 | 29 5/8 | 29 5/8 |
| B011 | J - CF HEIGHT | -1/8 | 1/8 | Grading | -3/8 | -1/4 | -1/8 | 0 | -3/8 | -1/4 | -1/8 | |
| | | | | Spec Meas | 2 1/8 | 2 1/4 | 2 3/8 | 2 1/2 | 2 1/8 | 2 1/4 | 2 3/8 | 2 1/2 |
| B012 | K - CB HEIGHT | -1/8 | 1/6 | Grading | 0 | 0 | 0 | 0 | 0 | 0 | 0 | |
| | | | | Spec Meas | 2 1/4 | 2 1/4 | 2 1/4 | 2 1/4 | 2 1/4 | 2 1/4 | 2 1/4 | 2 1/4 |
| B012 | L - BACK WING HEIGHT (FROM STRAP PLATFORM TO BOTTOM WING EDG | -1/8 | 1/8 | Grading | -9/16 | -3/8 | -3/16 | 0 | -9/16 | -3/8 | -3/16 | |
| | | | | Spec Meas | 7 5/8 | 7 13/16 | 8 | 8 3/16 | 7 5/8 | 7 13/16 | 8 | 8 3/16 |

FIG. 11A

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | | | | | | | | | | |
|---|---|---|---|---|---|---|---|---|---|---|---|---|---|
| | | | | Size Code | 38DDD | 38F | 38G | 38H | 40B | 40C | 40D | 40DD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP FLATFORM | -1/4 | 1/4 | Grading | 1/4 | 1/8 | 1/4 | 1/2 | -1/4 | -1/8 | 0 | 1/4 |
| | | | | Spec Meas | 8 1/4 | 8 1/8 | 8 1/4 | 8 1/2 | 7 3/4 | 7 7/8 | 8 | 8 1/4 |
| B002 | B - UNDERARM (FROM STRAP PLATFORM TO SEAM EXCL WIRE) | -1/8 | 1/8 | Grading | 1/4 | 1/4 | 1/2 | 5/8 | -1/4 | -1/8 | 0 | 1/4 |
| | | | | Spec Meas | 4 3/4 | 4 3/4 | 5 | 5 1/8 | 4 1/4 | 4 3/8 | 4 1/2 | 4 3/4 |
| B003 | C - WIRE CHANNEL | -1/8 | 1/8 | Grading | 5/8 | 1 1/4 | 1 7/8 | 2 1/2 | -1 1/4 | -5/8 | 0 | 5/8 |
| | | | | Spec Meas | 12 3/8 | 13 | 13 5/8 | 14 1/4 | 10 1/2 | 11 1/8 | 11 3/4 | 12 3/8 |
| B004 | D - WIRE PLAY | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | 0 |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | 3/16 | -1 1/16 | -7/8 | -1/16 | -5/16 | -1/8 | 1/16 | 1/4 |
| | | | | Spec Meas | 6 9/16 | 5 5/6 | 5 1/2 | 5 11/16 | 6 1/16 | 6 1/4 | 6 7/16 | 6 5/8 |
| B006 | G - TOP BACK (FM CUP/WING SEAM TO STRAP EDGE, ALONG CURVED EDGE) | -1/4 | 1/4 | Grading | -3/8 | -3/4 | -1 1/8 | -1/2 | 1 5/8 | 1 1/4 | 7/8 | 1/2 |
| | | | | Spec Meas | 8 1/2 | 8 1/8 | 7 3/4 | 7 3/8 | 10 1/2 | 10 1/8 | 9 3/4 | 9 3/8 |
| B008 | H - TOP CF | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE) | -1/2 | 1/2 | Grading | 0 | 0 | 0 | 0 | 2 | 2 | 2 | 2 |
| | | | | Spec Meas | 29 5/6 | 29 5/8 | 29 5/8 | 29 5/8 | 31 5/8 | 31 5/8 | 31 5/8 | 31 5/8 |
| B011 | J - CF HEIGHT | -1/8 | 1/8 | Grading | 1/6 | 1/4 | 3/8 | 1/2 | -1/4 | -1/8 | 0 | 1/8 |
| | | | | Spec Meas | 2 5/8 | 2 3/4 | 2 7/8 | 3 | 2 1/4 | 2 3/8 | 2 1/2 | 2 5/8 |
| B012 | K - CB HEIGHT | -1/8 | 1/6 | Grading | 0 | 1 1/2 | 1 1/2 | 1 1/2 | 0 | 0 | 0 | 0 |
| | | | | Spec Meas | 2 1/4 | 3 3/4 | 3 3/4 | 3 3/4 | 2 1/4 | 2 1/4 | 2 1/4 | 2 1/4 |
| B012 | L - BACK WING HEIGHT (FROM STRAP PLATFORM TO BOTTOM WING EDG | -1/8 | 1/8 | Grading | 3/16 | 3/8 | 9/16 | 3/4 | -3/8 | -3/16 | 0 | 3/16 |
| | | | | Spec Meas | 8 3/8 | 8 9/16 | 8 3/4 | 8 15/16 | 7 13/16 | 8 | 8 3/16 | 8 3/8 |

FIG. 11B

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | Size Code | 40DDD | 40F | 40G | 40H | 42B | 42C | 42D | 42DD |
|---|---|---|---|---|---|---|---|---|---|---|---|---|
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP PLATFORM | -1/4 | 1/4 | Grading | 1/8 | 1/4 | 1/2 | 5/8 | -1/8 | 0 | 1/4 | 1/8 |
| | | | | Spec Meas | 8 1/8 | 8 1/4 | 8 1/2 | 8 5/8 | 7 7/8 | 8 | 8 1/4 | 8 1/8 |
| B002 | B - UNDERARM (FROM STRAP PLATFORM TO SEAM EXCL WIRE) | -1/8 | 1/8 | Grading | 1/4 | 1/2 | 5/8 | 3/4 | -1/8 | 0 | 1/4 | 1/4 |
| | | | | Spec Meas | 4 3/4 | 5 | 5 1/8 | 5 1/4 | 4 3/8 | 4 1/2 | 4 3/4 | 4 3/4 |
| B003 | C - WIRE CHANNEL | -1/8 | 1/8 | Grading | 1 1/4 | 1 7/8 | 2 1/2 | 3 1/8 | -5/8 | 0 | 5/8 | 1 1/4 |
| | | | | Spec Meas | 13 | 13 5/8 | 14 1/4 | 14 7/8 | 11 1/8 | 11 3/4 | 12 3/8 | 13 |
| B004 | D - WIRE PLAY | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | 0 |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | -1/4 | -13/16 | -5/8 | -7/16 | -1/16 | 1/8 | 5/16 | -3/16 |
| | | | | Spec Meas | 6 1/8 | 5 9/16 | 5 3/4 | 5 15/16 | 6 5/16 | 6 1/2 | 6 11/16 | 6 3/16 |
| B006 | G - TOP BACK (FM CUP/WING SEAM TO STRAP EDGE,ALONG CURVED EDGE) | -1/4 | 1/4 | Grading | 1/8 | -1/4 | -5/8 | -1 | 2 1/8 | 1 3/4 | 1 3/8 | 1 |
| | | | | Spec Meas | 9 | 8 5/8 | 8 1/4 | 7 7/8 | 11 | 10 5/8 | 10 1/4 | 9 7/8 |
| B008 | H - TOP CF | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE | -1/2 | 1/2 | Grading | 2 | 2 | 2 | 2 | 4 | 4 | 4 | 4 |
| | | | | Spec Meas | 31 5/8 | 31 5/8 | 31 5/8 | 31 5/8 | 33 5/8 | 33 5/8 | 33 5/8 | 33 5/8 |
| B011 | J - CF HEIGHT | -1/8 | 1/8 | Grading | 1/4 | 3/8 | 1/2 | 5/8 | -1/8 | 0 | 1/8 | 1/4 |
| | | | | Spec Meas | 2 3/4 | 2 7/8 | 3 | 3 1/8 | 2 3/8 | 2 1/2 | 2 5/8 | 2 3/4 |
| B012 | K - CB HEIGHT | -1/8 | 1/8 | Grading | 3/4 | 1 1/2 | 1 1/2 | 1 1/2 | 0 | 0 | 0 | 3/4 |
| | | | | Spec Meas | 3 | 3 3/4 | 3 3/4 | 3 3/4 | 2 1/4 | 2 1/4 | 2 1/4 | 3 |
| B012 | L - BACK WING HEIGHT (FROM STRAP PLATFORM TO BOTTOM WING EDG | -1/8 | 1/8 | Grading | 3/8 | 9/16 | 3/4 | 15/16 | -3/16 | 0 | 3/16 | 1 3/8 |
| | | | | Spec Meas | 8 9/16 | 8 3/4 | 8 15/16 | 9 1/8 | 8 | 8 3/16 | 8 3/8 | 9 9/16 |

FIG. 11C

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | Size Code | 42DDD | 42F | 42G | 42H | 44B | 44C | 44D | 44DD |
|---|---|---|---|---|---|---|---|---|---|---|---|---|
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP PLATFORM | -1/4 | 1/4 | Grading | 1/4 | 1/2 | 5/8 | 3/4 | 0 | 1/4 | 1/8 | 1/4 |
| | | | | Spec Meas | 8 1/4 | 8 1/2 | 8 5/8 | 8 3/4 | 8 | 8 1/4 | 8 1/8 | 8 1/4 |
| B002 | B - UNDERARM (FROM STRAP PLATFORM TO SEAM EXCL WIRE) | -1/8 | 1/8 | Grading | 1/2 | 5/8 | 3/4 | 7/8 | 0 | 1/4 | 1/4 | 1/2 |
| | | | | Spec Meas | 5 | 5 1/8 | 5 1/4 | 5 3/8 | 4 1/2 | 4 3/4 | 4 3/4 | 5 |
| B003 | C - WIRE CHANNEL | -1/8 | 1/8 | Grading | 1 7/8 | 2 1/2 | 3 1/8 | 3 3/4 | 0 | 5/8 | 1 1/4 | 1 7/8 |
| | | | | Spec Meas | 13 5/8 | 14 1/4 | 14 7/8 | 15 1/2 | 11 3/4 | 12 3/8 | 13 | 13 5/8 |
| B004 | D - WIRE PLAY | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | 0 |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | 0 | -9/16 | -3/8 | -3/16 | 3/16 | 3/8 | -1/8 | 1/16 |
| | | | | Spec Meas | 6 3/8 | 5 13/16 | 6 | 6 3/16 | 6 9/16 | 6 3/4 | 6 1/4 | 6 7/16 |
| B006 | G - TOP BACK (FM CUP/WING SEAM TO STRAP EDGE,ALONG CURVED EDGE) | -1/4 | 1/4 | Grading | 5/8 | 1/4 | -1/8 | -1/2 | 2 5/8 | 2 1/4 | 1 7/8 | 1 1/2 |
| | | | | Spec Meas | 9 1/2 | 9 1/8 | 8 3/4 | 8 3/8 | 11 1/2 | 11 1/8 | 10 3/4 | 10 3/8 |
| B008 | H - TOP CF | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE | -1/2 | 1/2 | Grading | 4 | 4 | 4 | 4 | 6 | 6 | 6 | 6 |
| | | | | Spec Meas | 33 5/8 | 33 5/8 | 33 5/8 | 33 5/8 | 35 5/8 | 35 5/8 | 35 5/8 | 35 5/8 |
| B011 | J - CF HEIGHT | -1/8 | 1/8 | Grading | 3/8 | 1/2 | 5/8 | 3/4 | 0 | 1/8 | 1/4 | 3/8 |
| | | | | Spec Meas | 2 7/8 | 3 | 3 1/8 | 3 1/4 | 2 1/2 | 2 5/8 | 2 3/4 | 2 7/8 |
| B012 | K - CB HEIGHT | -1/8 | 1/8 | Grading | 3/4 | 1 1/2 | 1 1/2 | 1 1/2 | 0 | 0 | 3/4 | 3/4 |
| | | | | Spec Meas | 3 | 3 3/4 | 3 3/4 | 3 3/4 | 2 1/4 | 2 1/4 | 3 | 3 |
| B012 | L - BACK WING HEIGHT (FROM STRAP PLATFORM TO BOTTOM WING EDG | -1/8 | 1/8 | Grading | 9/16 | 3/4 | 15/16 | 1 1/8 | 0 | 0 | 3/8 | 9/16 |
| | | | | Spec Meas | 8 3/4 | 8 15/16 | 9 1/8 | 9 5/16 | 8 3/16 | 8 3/16 | 8 9/16 | 8 3/4 |

FIG. 11D

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | | | | | | | | | |
|---|---|---|---|---|---|---|---|---|---|---|---|---|
| | | | | Size Code | 44DDD | 44F | 44G | 46B | 46C | 46D | 46DD | 46DDD |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP PLATFORM | -1/4 | 1/4 | Grading | 1/2 | 5/8 | 3/4 | 1/4 | 1/8 | 1/4 | 1/2 | 5/8 |
| | | | | Spec Meas | 8 1/2 | 8 5/8 | 8 3/4 | 8 1/4 | 8 1/8 | 8 1/4 | 8 1/2 | 8 5/8 |
| B002 | B - UNDERARM (FROM STRAP PLATFORM TO SEAM EXCL WIRE) | -1/8 | 1/8 | Grading | 5/8 | 3/4 | 7/8 | 1/4 | 1/4 | 1/2 | 5/8 | 3/4 |
| | | | | Spec Meas | 5 1/8 | 5 1/4 | 5 3/8 | 4 3/4 | 4 3/4 | 5 | 5 1/8 | 5 1/4 |
| B003 | C - WIRE CHANNEL | -1/8 | 1/8 | Grading | 2 1/2 | 3 1/8 | 3 3/4 | 5/8 | 1 1/4 | 1 7/8 | 2 1/2 | 3 1/8 |
| | | | | Spec Meas | 14 1/4 | 14 7/8 | 15 1/2 | 12 3/8 | 13 | 13 5/8 | 14 1/4 | 14 7/8 |
| B004 | D - WIRE PLAY | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | 0 |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | 1/4 | -5/16 | -1/8 | 7/16 | -1/16 | 1/8 | 5/16 | 1/2 |
| | | | | Spec Meas | 6 5/8 | 6 1/16 | 6 1/4 | 6 13/16 | 6 5/16 | 6 1/2 | 6 11/16 | 6 7/8 |
| B006 | G - TOP BACK (FM CUP/WING SEAM TO STRAP EDGE,ALONG CURVED EDGE) | -1/4 | 1/4 | Grading | 1 1/8 | 3/4 | 3/8 | 3 1/8 | 2 3/4 | 2 3/8 | 2 | 1 5/8 |
| | | | | Spec Meas | 10 | 9 5/8 | 9 1/4 | 12 | 11 5/8 | 11 1/4 | 10 7/8 | 10 1/2 |
| B008 | H - TOP CF | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE | -1/2 | 1/2 | Grading | 6 | 6 | 6 | 8 | 8 | 8 | 8 | 8 |
| | | | | Spec Meas | 35 5/8 | 35 5/8 | 35 5/8 | 37 5/8 | 37 5/8 | 37 5/8 | 37 5/8 | 37 5/8 |
| B011 | J - CF HEIGHT | -1/8 | 1/8 | Grading | 1/2 | 5/8 | 3/4 | 1/8 | 1/4 | 3/8 | 1/2 | 5/8 |
| | | | | Spec Meas | 3 | 3 1/8 | 3 1/4 | 2 5/8 | 2 8/4 | 2 7/8 | 3 | 3 1/8 |
| B012 | K - CB HEIGHT | -1/8 | 1/8 | Grading | 3/4 | 1 1/2 | 1 1/2 | 3/4 | 3/4 | 3/4 | 3/4 | 3/4 |
| | | | | Spec Meas | 3 | 3 3/4 | 3 3/4 | 3 | 3 | 3 | 3 | 3 |
| B012 | L - BACK WING HEIGHT (FROM STRAP PLATFORM TO BOTTOM WING EDG | -1/8 | 1/8 | Grading | 3/4 | 15/16 | 1 1/8 | 3/16 | 3/8 | 9/16 | 3/4 | 15/16 |
| | | | | Spec Meas | 8 15/16 | 9 1/8 | 9 5/16 | 8 3/8 | 8 9/16 | 8 3/4 | 8 15/16 | 9 1/8 |

FIG. 11E

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| **Model Name** | BRAS |
|---|---|

| | | | | | | | | | | | | | |
|---|---|---|---|---|---|---|---|---|---|---|---|---|---|
| | | | | Size Code | 48B | 48C | 48D | 48DD | 48DDD | 50B | 50C | 50D |
| | | | | Active Size | Yes | Yes | Yes | Yes | Yes | Yes | Yes | Yes |
| | | | | Sample Size | No | No | No | No | No | No | No | No |
| **POM Code** | **POM Description** | **TOL (-)** | **TOL (+)** | | | | | | | | | |
| B001 | A - NECKLINE (EXCL WIRE ALONG NECKLINE TO STRAP PLATFORM | -1/4 | 1/4 | Grading | 1/8 | 1/4 | 1/2 | 5/8 | 3/4 | 1/4 | 1/2 | 5/8 |
| | | | | Spec Meas | 8 1/8 | 8 1/4 | 8 1/2 | 8 5/8 | 8 3/4 | 8 1/4 | 8 1/2 | 8 5/8 |
| B002 | B - UNDERARM (FROM STRAP PLATFORM TO SEAM EXCL WIRE) | -1/8 | 1/8 | Grading | 1/4 | 1/2 | 5/8 | 3/4 | 7/8 | 1/2 | 5/8 | 3/4 |
| | | | | Spec Meas | 4 3/4 | 5 | 5 1/8 | 5 1/4 | 5 3/8 | 5 | 5 1/8 | 5 1/4 |
| B003 | C - WIRE CHANNEL | -1/8 | 1/8 | Grading | 1 1/4 | 1 7/8 | 2 1/2 | 3 1/8 | 3 3/4 | 1 7/8 | 2 1/2 | 3 1/8 |
| | | | | Spec Meas | 13 | 13 5/8 | 14 1/4 | 14 7/8 | 15 1/2 | 13 5/8 | 14 1/4 | 14 7/8 |
| B004 | D - WIRE PLAY | -1/8 | 1/8 | Grading | 0 | 0 | 0 | 0 | 0 | 0 | 0 | 0 |
| | | | | Spec Meas | 3/8 | 3/8 | 3/8 | 3/8 | 3/8 | 3/8 | 3/8 | 3/8 |
| B005 | E - STRAP LENGTH W/ 2 1/2" ADJUST | -1/4 | 1/4 | Grading | 0 | 0 | 0 | 0 | 0 | 0 | 0 | 0 |
| | | | | Spec Meas | 8 1/4 | 8 1/4 | 8 1/4 | 8 1/4 | 8 1/4 | 8 1/4 | 8 1/4 | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | 0 | 3/16 | 3/8 | 9/16 | 3/4 | 1/4 | 7/16 | 5/8 |
| | | | | Spec Meas | 6 3/8 | 6 9/16 | 6 3/4 | 6 15/16 | 7 1/8 | 6 5/8 | 6 13/16 | 7 |
| B006 | G - TOP BACK (FM CUP/WING SEAM TO STRAP EDGE,ALONG CURVED EDGE) | -1/4 | 1/4 | Grading | 3 5/8 | 3 1/4 | 2 7/8 | 2 1/2 | 2 1/8 | 4 1/8 | 3 3/4 | 3 3/8 |
| | | | | Spec Meas | 12 1/2 | 12 1/8 | 11 3/4 | 11 3/8 | 11 | 13 | 12 5/8 | 12 1/4 |
| B008 | H - TOP CF | -1/8 | 1/8 | Grading | 0 | 0 | 0 | 0 | 0 | 0 | 0 | 0 |
| | | | | Spec Meas | 1/4 | 1/4 | 1/4 | 1/4 | 1/4 | 1/4 | 1/4 | 1/4 |
| B010 | I - TTL BOTTOM BAND - FM 1ST HOOK TO EYE | -1/2 | 1/2 | Grading | 10 | 10 | 10 | 10 | 10 | 12 | 12 | 12 |
| | | | | Spec Meas | 39 5/8 | 39 5/8 | 39 5/8 | 39 5/8 | 39 5/8 | 41 5/8 | 41 5/8 | 41 5/8 |
| B011 | J - CF HEIGHT | -1/8 | 1/8 | Grading | 1/4 | 3/8 | 1/2 | 5/8 | 3/4 | 3/8 | 1/2 | 5/8 |
| | | | | Spec Meas | 2 3/4 | 2 7/8 | 3 | 3 1/8 | 3 1/4 | 2 7/8 | 3 | 3 1/8 |
| B012 | K - CB HEIGHT | -1/8 | 1/8 | Grading | 3/4 | 3/4 | 3/4 | 3/4 | 3/4 | 3/4 | 3/4 | 7/8 |
| | | | | Spec Meas | 3 | 3 | 3 | 3 | 3 | 3 | 3 | 3 1/8 |
| B012 | L - BACK WING HEIGHT (FROM STRAP PLATFORM TO BOTTOM WING EDG | -1/8 | 1/8 | Grading | 3/8 | 9/16 | 3/4 | 15/16 | 1 1/8 | 9/16 | 3/4 | 15/16 |
| | | | | Spec Meas | 8 9/16 | 8 3/4 | 8 15/16 | 9 1/8 | 9 5/16 | 8 3/4 | 8 15/16 | 9 1/8 |

FIG. 11F

360 SMOOTHING T-SHIRT BRA

Points of Measure

| | | | | | | | | | |
|---|---|---|---|---|---|---|---|---|---|
| **Brand/Div** | TORRID | **PD Season Year** | TD SPRING 2018 | **Designer** | VLACAMBRA | **PD Sourcing Mgr** | MEGHAN QUINN | **Create Date** | 06/29/2017 |
| **Dept** | FOUNDATIONS | **PD Season Code** | SPRING1 | **Tech Des.** | CROBLES | **Request No** | 0000033266 | **Revised Date** | 05/16/2018 |
| **Prod. Category** | BRAS | **Size** | TD BRAS 36-52 | **Product Mgr** | VLACAMBRA | **PD Style No/ VSN No** | 62-33266 | **Status** | NEW |

| | |
|---|---|
| **Model Name** | BRAS |

| | |
|---|---|
| Size Code | 50DD |
| Active Size | Yes |
| Sample Size | No |

| POM Code | POM Description | TOL (-) | TOL (+) | | |
|---|---|---|---|---|---|
| B001 | A - NECKLINE (EXCL WIRE ALONG NECKLINE TO STRAP PLATFORM | -1/4 | 1/4 | Grading | 3/4 |
| | | | | Spec Meas | 8 3/4 |
| B002 | B - UNDERARM (FROM STRAP PLATFORM TO SEAM EXCL WIRE) | -1/8 | 1/8 | Grading | 7/8 |
| | | | | Spec Meas | 5 3/8 |
| B003 | C - WIRE CHANNEL | -1/8 | 1/8 | Grading | 3 3/4 |
| | | | | Spec Meas | 15 1/2 |
| B004 | D - WIRE PLAY | -1/8 | 1/8 | Grading | 0 |
| | | | | Spec Meas | 3/8 |
| B005 | E - STRAP LENGTH W/ 2 1/2" ADJUST | -1/4 | 1/4 | Grading | 0 |
| | | | | Spec Meas | 8 1/4 |
| GEN002 | F - CB NECKLINE (MEASURE ALOINSIDE OF ELASTIC, TO HOOK SEAM (NO HOOK AND EYE) | -1/4 | 1/4 | Grading | 13/16 |
| | | | | Spec Meas | 7 3/16 |
| B006 | G - TOP BACK (FM CUP/WING SEAM TO STRAP EDGE,ALONG CURVED EDGE) | -1/4 | 1/4 | Grading | 3 |
| | | | | Spec Meas | 11 7/8 |
| B008 | H - TOP CF | -1/8 | 1/8 | Grading | 0 |
| | | | | Spec Meas | 1/4 |
| B010 | I - TTL BOTTOM BAND - FM 1ST HOOK TO EYE | -1/2 | 1/2 | Grading | 12 |
| | | | | Spec Meas | 41 5/8 |
| B011 | J - CF HEIGHT | -1/8 | 1/8 | Grading | 3/4 |
| | | | | Spec Meas | 3 1/4 |
| B012 | K - CB HEIGHT | -1/8 | 1/8 | Grading | 3/4 |
| | | | | Spec Meas | 3 |
| B012 | L - BACK WING HEIGHT (FROM STRAP PLATFORM TO BOTTOM WING EDG | -1/8 | 1/8 | Grading | 1 1/8 |
| | | | | Spec Meas | 9 5/16 |

FIG. 11G

REDUCED-COVERAGE BACK-SMOOTHING BRASSIERE

CROSS-REFERENCE TO RELATED APPLICATIONS

This application is a continuation of U.S. Nonprovisional Application Ser. No. 16/538,749, filed Aug. 12, 2019, and entitled "Reduced-Coverage Back-Smoothing Brassiere," now U.S. Pat. No. 11,632,990, which claims the benefit of U.S. Provisional Patent Application Ser. 62/717,667, filed Aug. 10, 2018 and entitled "360 Back Smoothing Bra," which are hereby incorporated by reference herein.

TECHNICAL FIELD

Embodiments of the invention relate generally to brassieres and more particularly to a reduced-coverage back-smoothing brassiere that avoids skin bulges and supports flattening the back.

BACKGROUND

A brassiere (often referred to as a bra) is an article of clothing many women wear to support their breasts in a manner that is comfortable and attractive. The need to wear a brassiere is particularly important for fuller-bodied women or women whose breast size is generally larger.

A wide range of brassiere designs have been offered to provide breast support while also attempting to pleasantly shape the breast and provide an attractive brassiere. A typical brassiere, shown from the back on a fuller-bodied woman is illustrated in FIG. 1.

Typical brassieres have two breast cups connected medially by a bridge. A wing 11 is connected to a lateral portion of each cup, and wraps around each direction of the woman's torso to a dorsal fastener 12. A strap 13 is connected to a top portion of each cup and wraps over each shoulder to a respective one of the wings 11. The dorsal fastener 12 on each wing 11 may include a fastening member to removably secure the brassiere. In the standard brassiere, the two wings 11 have substantially uniform width from a top edge 15 to a bottom edge 16. When the dorsal fastener 12 is connected, the wings 11 and straps 13 expose a medial dorsal portion of the woman's back, including the woman's head, neck, upper portion of the woman's shoulders and upper portion of the woman's back. As shown, the medial dorsal portion is substantially framed by brassiere parts in the shape of the upper portion of an "H." Notably, on the side of the medial dorsal portion, the straps 13 and wings 11 form an obtuse angle, as illustrated in FIG. 1.

Traditional brassieres are typically formed using multiple layers of fabric that sandwich a power mesh with a high modulus of elasticity. The power mesh can be a fabric that applies independent elastic forces in two dimensions (e.g., horizontally and vertically) when stretched. Notably, as shown in FIG. 1, the forces imposed by the brassiere straps 13 and wings 11 can cause unsightly skin bulges.

Further, traditional brassieres are often uncomfortable when worn for long time periods (e.g., a full day). The discomfort is exacerbated for fuller-bodied women and woman having larger breast sizes.

To address the unsightly bulges, traditional brassieres often use oversized wings and oversized straps, often referred to as "back smoothing" brassieres. As shown in FIG. 2, back smoothing configurations cover substantial portions of the woman's back and sides. The result is a brassiere where the dorsal medial portion is substantially in the shape of a "V," created by the top edge 22 of wings 21. Further, the curve of the top edge 22 is not a continuously curved in a concave shape. As can be seen, the top edge 22 forms a convex portion 22A in addition to a concave portion 22B, substantially forming an "S" shape or a reverse "S" shape.

Like other traditional brassieres, the materials of back-smoothing brassieres similarly include multiple layers of fabric that sandwich a power mesh with a high modulus of elasticity. The power mesh is intended to direct the wearer's skin to conform with the shape of the oversized straps and wings. The multiple layers of fabric may include a barrier layer to protect the woman's skin from the coarse surface of the power mesh and/or to provide cushioning between the woman's skin and the power mesh.

Traditional back-smoothing brassieres are often heavy and provide less air permeability, causing the woman to feel uncomfortably warm and/or to sweat. Further, the increased size of these back-smoothing brassieres impose limitations on clothing that the woman may wear in order to cover the oversized brassiere. For example, the woman shown in FIG. 2 will have difficulty wearing a tank top or top with an open back without exposing a substantial portion of the brassiere.

There is a need for a brassiere that provides breast support, especially for fuller-bodied women or woman having larger breast size, that is comfortable to wear for long time periods, contours the body without causing unsightly bulges, and does not unduly restrict clothing choices.

SUMMARY

An example reduced-coverage back-smoothing brassiere comprises two brassiere cups including a right brassiere cup and a left brassiere cup, two brassiere wings, including a left brassiere wing and a right brassiere wing, each of the two brassiere wings including a first attachment portion, a second attachment portion, a first edge, a second edge, and a third edge, the first attachment portion of the left brassiere wing being coupled to at least a portion of the left brassiere cup, the first attachment portion of the right brassiere wing being coupled to at least a portion of the right brassiere cup, the third edge of each of the two brassiere wings extending towards a fastening section of the brassiere, the third edge of the right brassiere wing being at least partially opposite the first edge of the right brassiere wing and the third edge of the left brassiere wing being at least partially opposite the first edge of the left brassiere wing, and two brassiere straps, including a right brassiere strap and a left brassiere strap, each of the two brassiere straps including a first portion opposite a second portion as well as an interior edge opposite an exterior edge, the first portion of the right brassiere strap being coupled to the second attachment portion of the right brassiere wing, the second attachment portion being between a first edge and a second edge of the right brassiere wing, the first portion of the left brassiere strap being coupled to the second attachment portion of the left brassiere wing, the second attachment portion being between a first edge and a second edge of the left brassiere wing, the first edge of the right brassiere wing being between the first attachment portion and the second attachment portion of the right brassiere wing, the first edge of the right brassiere wing being a continuous curve leading to the exterior edge of the right brassiere wing, and the first edge of the left brassiere wing being between the first attachment portion and the second attachment portion of the left brassiere wing, the first edge of the left brassiere wing being a continuous curve leading to the exterior edge of the left brassiere wing, the second portion of the right brassiere strap being coupled to the right brassiere cup and the second portion of the left brassiere strap being coupled to the left brassiere cup, the second edge of the right brassiere strap extending in an unbroken curve from the second portion of the right brassiere strap toward the fastening section, the second edge of the left brassiere strap extending in an unbroken curve from the second portion of the left brassiere strap toward the fastening section, a continuous, unbroken curve being created by the interior edge of each of the two brassiere straps along the second edge of each of the two brassiere wings, respectively.

In various embodiments, the continuous, unbroken curve is a concave curve. The continuous, unbroken curve may be a catenary shape. The brassiere may have a length of at least 27.5 inches, the length of the brassiere measuring along the third edge of each of the two brassiere wings and along the fastening section. In some embodiments, the first edge of each brassiere wing is at least 7⅜ inches, and/or each of the two brassiere wings includes a uniform modulus of elasticity.

Each of the two brassiere wings may have a plurality of areas with different modulus of elasticity. A first area of the brassiere wing closer to a first edge of the brassiere wing may have a lower modulus of elasticity than a second area of the brassiere wing further from the first edge of the brassiere wing.

An example method of fabricating a brassiere may include receiving two brassiere cups including a right brassiere cup and a left brassiere cup, receiving two brassiere wings, including a left brassiere wing and a right brassiere wing, each of the two brassiere wings including a first attachment portion, a second attachment portion, a first edge, a second edge, and a third edge, coupling the first attachment portion of the left brassiere wing to at least a portion of the left brassiere cup and coupling the first attachment portion of the right brassiere wing being coupled to at least a portion of the right brassiere cup, the third edge of each of the two brassiere wings extending towards a fastening section of the brassiere, the third edge of the right brassiere wing being at least partially opposite the first edge of the right brassiere wing and the third edge of the left brassiere wing being at least partially opposite the first edge of the left brassiere wing, receiving two brassiere straps, including a right brassiere strap and a left brassiere strap, each of the two brassiere straps including a first portion opposite a second portion as well as an interior edge opposite an exterior edge, and coupling the first portion of the right brassiere strap to the second attachment portion of the right brassiere wing, the second attachment portion being between a first edge and a second edge of the right brassiere wing, and coupling the first portion of the left brassiere strap to the second attachment portion of the left brassiere wing, the second attachment portion being between a first edge and a second edge of the left brassiere wing, the first edge of the right brassiere wing being between the first attachment portion and the second attachment portion of the right brassiere wing, the first edge of the right brassiere wing being a continuous curve leading to the exterior edge of the right brassiere wing, and the first edge of the left brassiere wing being between the first attachment portion and the second attachment portion of the left brassiere wing, the first edge of the left brassiere wing being a continuous curve leading to the exterior edge of the left brassiere wing, the second portion of the right brassiere strap being coupled to the right brassiere cup and the second portion of the left brassiere strap being coupled to the left brassiere cup, the second edge of the right brassiere cup extending in an unbroken curve from the second portion of the right brassiere strap toward the fastening section, the second edge of the left brassiere cup extending in an unbroken curve from the second portion of the left brassiere strap toward the fastening section, a continuous, unbroken curve being created by the interior edge of each of the two brassiere straps along the second edge of each of the two brassiere wings, respectively.

BRIEF DESCRIPTION OF THE DRAWINGS

FIGS. 10A-10G show example characteristics of a reduced-coverage back-smoothing brassiere (e.g., the reduced-coverage back-smoothing brassiere of FIG. 8) according to some embodiments of the invention.

FIGS. 11A-11H show example characteristics of a reduced-coverage back-smoothing brassiere (e.g., the reduced-coverage back-smoothing brassiere of FIG. 3) according to some embodiments of the invention.

DETAILED DESCRIPTION

Figure 1:
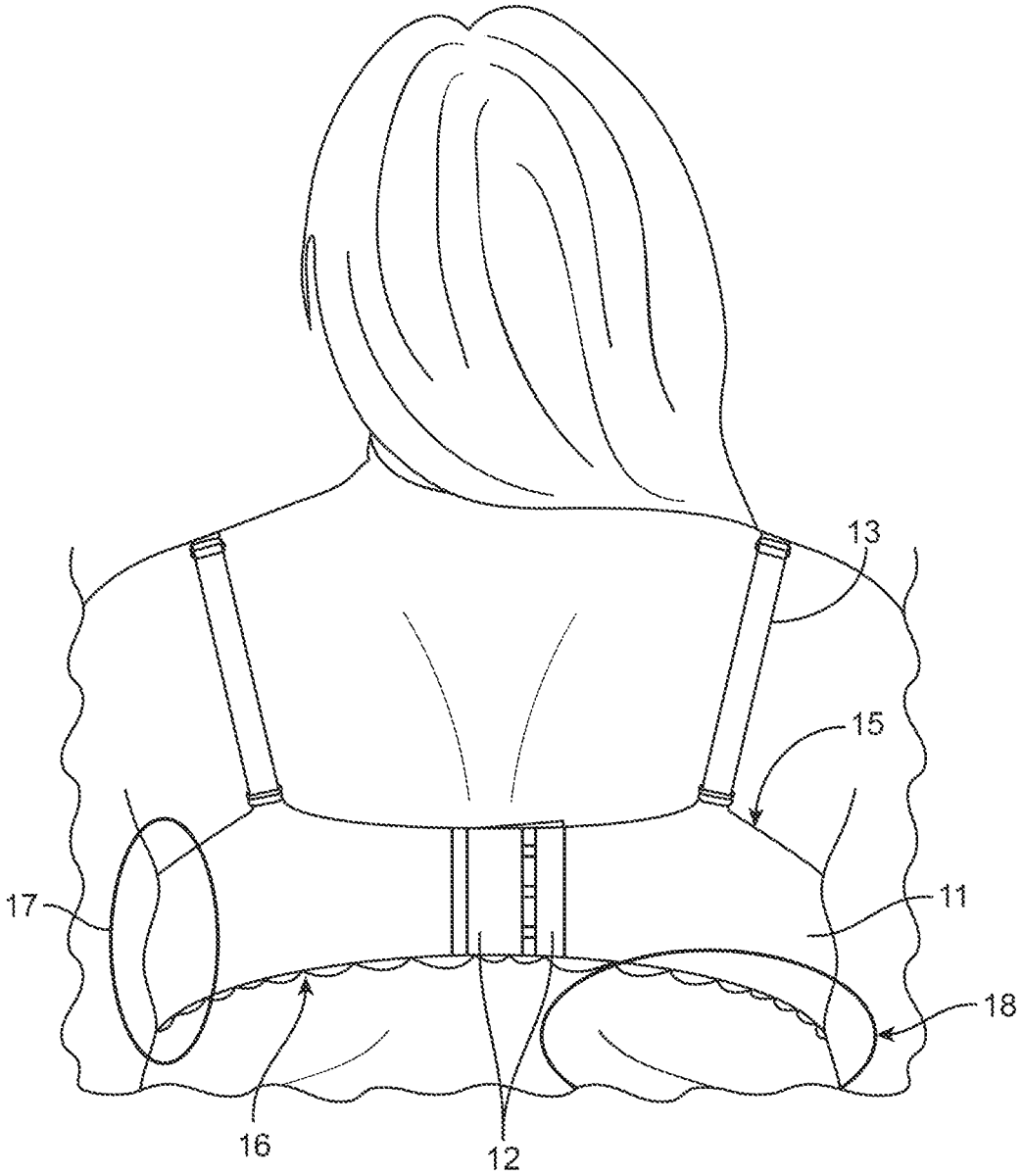
FIG. 1 (PRIOR ART)
FIG. 1 shows a back portion of a traditional brassiere, in accordance with the prior art.

Reduced-coverage back-smoothing brassiere configurations described herein will be comfortable to wear, provide support especially for fuller-bodied women and/or women with larger breasts sizes, contour the body well to avoid unsightly bulges, are more discreet, and/or have a smaller footprint than traditional brassieres. As used herein, "reduced-coverage" (or, "limited-coverage") may refer to the back area and/or underarm area of a wearer that is covered by a brassiere. For example, the area covered by the reduced-coverage back-smoothing brassiere described herein may be reduced and/or limited relative to the areas covered by traditional brassieres (e.g., as shown in FIG. 1 and/or FIG. 2). The shape of a reduced-coverage back-smoothing brassiere enables a dorsal medial portion of the back of a wearer (e.g., a woman, a man) to form more of a "U" shape, rather than an "H" shape or a "V" shape. By forming the dorsal medial opening to have a more tapered "U" shape, embodiments may better support fuller-bodied women and/or women with larger breasts. Various embodiments are less visible under delicate or smaller tops, such as camisoles, strap dresses, scoop-neck shirts, and tank tops. Although women are used as example wearers of the reduced-coverage back-smoothing brassieres described herein, it will be appreciated that a wearer may be of any gender (e.g., female, male), and the reduced-coverage back-smoothing brassieres described herein may be worn by a wearer of any gender. Accordingly, the reduced-coverage back-smoothing brassieres described herein, and the benefits provided by the reduced-coverage back-smoothing brassieres described herein, may be gender-neutral.

In various embodiments, the reduced-coverage back-smoothing brassiere discussed herein may include brassiere wings and brassiere straps with a substantially smaller footprint on the wearer's back and/or which use a fabric with a lower modulus of elasticity. These embodiments may provide a brassiere which is more comfortable to wear for long periods of time and/or provides support for the wearer's breasts as well as back smoothing without undue limitations on the woman's wardrobe.

One or more of the reduced-coverage back-smoothing brassiere embodiments discussed herein provide reduced-coverage back-smoothing functions by a gentle shaping and smoothing of the back through the interplay of the reduced-coverage back-smoothing brassiere's geometry of the shoulder straps, the wings, and/or the connection between the two. These elements, as described elsewhere herein, form an opening across the wearer's back that has a smooth transition edge that is open and continuously concave to a center or a mid-portion of the wearer's back. Thus, embodiments are provided that form an opening between the brassiere straps and the connected brassiere wings that approximates one or more parabolas and/or a catenary shape. As used herein, a catenary shape may include a weighted or a modified catenary shape. Catenary shapes are described elsewhere herein.

The fabric used in the reduced-coverage back-smoothing brassiere elements, particularly the brassiere wing, can vary by particular embodiments. Some embodiments include a relaxed fabric made up of fewer layers and a lower modulus of elasticity than conventional brassieres, particularly in back smoothing brassieres for fuller-bodied women, thereby providing an undergarment that may be comfortably worn for long periods of time. Various disclosed embodiments provide a reduced-coverage back-smoothing brassiere with adequate coverage in the upper back area to provide the back-smoothing function, but does not provide unnecessary coverage like typical prior art back-smoothing brassieres.

The disclosed embodiments provide a reduced-coverage back-smoothing brassiere that provides support for the wearer's breasts and at the same time provides back-smoothing with minimally restrictive back coverage and containment. Furthermore, the embodiments of the reduced-coverage back-smoothing brassiere is comfortable to wear for longer periods of time (e.g., an entire work day) while at the same time providing an open-back appearance and seamless (or semi-seamless) fit so as to not disrupt the wearer's choice of clothing or appear unsightly under delicate fabric tops, in contrast to the more-restrictive prior art back-smoothing brassieres.

In some embodiments, the inside edge (or, interior edge) of the shoulder strap descends in generally a straight line as it descends from the shoulder area towards the attachment point to the wing. As it nears the wing, the inside line may begin to taper like a parabola with a curve that flattens towards the clasp in the middle of the fastener. In some embodiments, the shape may be more catenary than a parabola. The inside line (or, edge) of the brassiere strap as it transitions into the back strap may remain consistently concave to the body.

Some embodiments of the reduced-coverage back-smoothing brassiere include a ballet back design, or a shape resembling a U-shaped back seen on a back view of a leotard (e.g., as worn by ballerinas). The ballet back design is achieved by the specific shape of the shoulder straps, the wing and the connection between the two. The inside edge of the shoulder strap descends in generally a straight line from the shoulder area towards the attachment point to the brassiere wing. As it nears the brassiere wing, the inside line begins to taper like a parabola with a curve that flattens towards the clasp in the middle of the fastener. In some embodiments, the shape may be more catenary than a parabola. The inside line of the brassiere strap as it transitions into the back strap may remain consistently concave to the body. The concave shape may provide adequate coverage in the upper back area where it is needed to provide the back-smoothing function but does not provide any unnecessary coverage as the prior art back-smoothing brassieres typically provide.

In some embodiments, the outer layer of the brassiere wings of the reduced-coverage back-smoothing brassiere and the back of the reduced-coverage back-smoothing brassiere are manufactured of microfiber, and the inner layer of the brassiere wings and back are manufactured with a power mesh that is a two-way (e.g., horizontal and vertical) stretch fabric. However, the power mesh used in the reduced-coverage back-smoothing brassiere in some embodiments may be less aggressive and may have a lower modulus of elasticity than the restrictive, more aggressive and higher modulus of elasticity power meshes used in the prior art back-smoothing brassieres. Also, this power mesh material may be breathable and thin, and because it is not sandwiched between solid layers of material like in the prior art brassieres, the reduced-coverage back-smoothing brassiere feels lighter and more comfortable. The brassiere cups of the reduced-coverage back-smoothing brassiere may be manufactured with the same microfiber that is on the outside of the brassiere wings and back.

Various features and construction of different embodiments discussed herein, as well as additional objects thereof, will be understood more fully from the following description when read in connection with the accompanying drawings.

Figure 2:
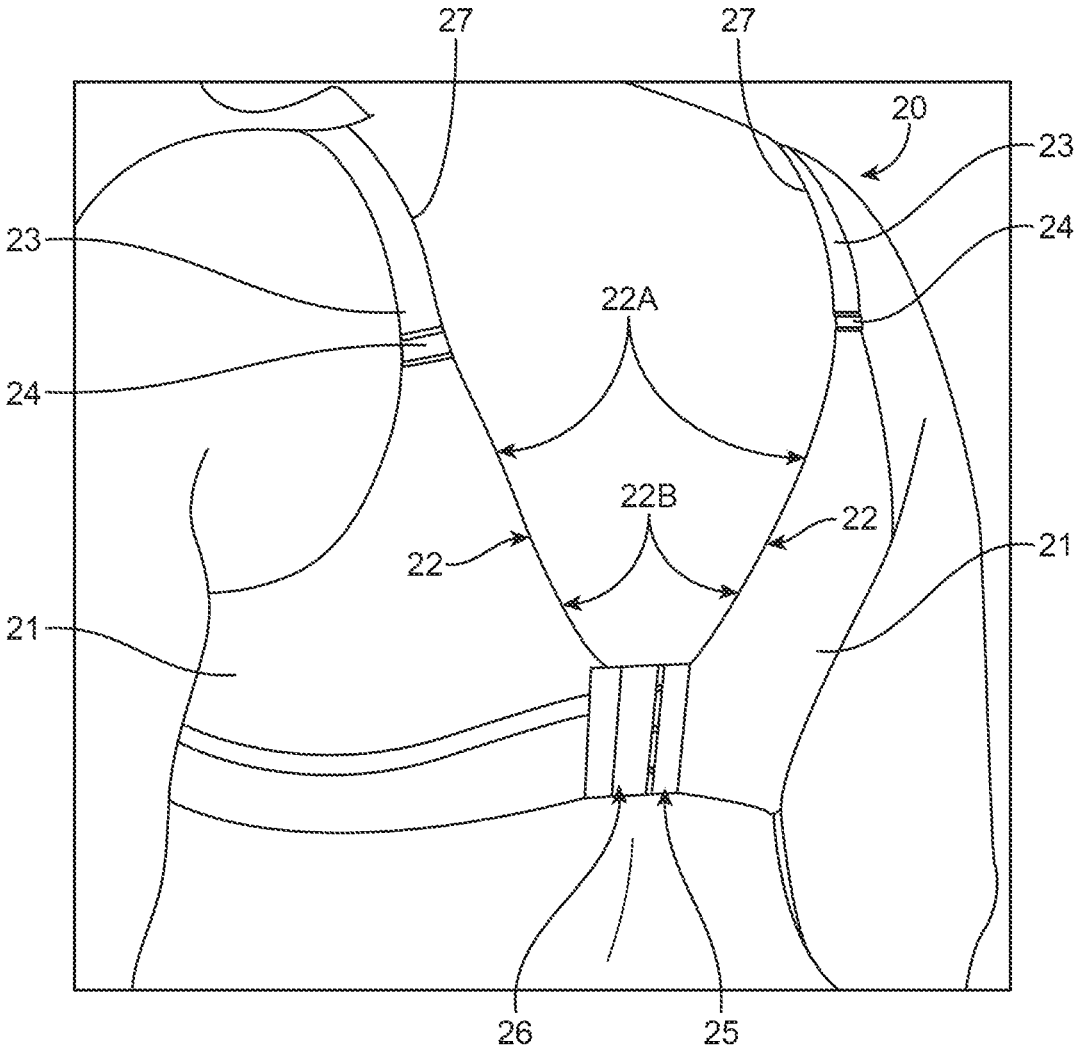
FIG. 2 (PRIOR ART)
FIG. 2 shows a back portion of a traditional back-smoothing brassiere, in accordance with the prior art.

Referring to FIG. 2, the prior art brassiere 20 that attempts to avoid bulges or lumps on a wearers back (e.g., a traditional back smoothing brassiere) are constructed with substantial fabric coverage of the woman's underarm and back areas. That fabric has a high modulus of elasticity to push and direct any loose skin in a manner the brassiere designer believes will minimize bulges or lumps. The forces on the woman's body from these prior art brassieres make the brassiere uncomfortable to wear for long periods of time and are constricting of the woman's movement and may reduce the styles and types of fabric for tops and dresses available to the wearer to cover the back smoothing brassiere. For example, a wearer wearing a conventional brassiere such as the brassiere 20 illustrated in FIG. 2 may feel compelled to avoid wearing scoop back tops, tank tops, or back less dresses due to the structure and configuration of the conventional back smoothing brassiere.

In addition, as illustrated in FIG. 2, traditional back smoothing brassieres expose only a narrow element of the woman's back, shown here substantially in a V-shape. This is due to the oversized configuration of the brassiere wings 21 and the edge line 22 of the brassiere wings 21 which extend substantially across the shoulder blades of the wearer. The "S" shaped or reverse "S" shaped nature of each of the edge line 22 on the brassiere wings 21 made up of convex portion 22A and concave portion 22B do not provide a smooth continuous curve. In addition, a discontinuity (or significant change in the angle and curve of the fabric line) exists in the line created along the edge line 22 of the brassiere wing 21 that faces the center of the wearer's back and the interior edge 27 of the brassiere strap 23 at a shoulder wing-strap junction 24 where the brassiere wings 21 connect with the brassiere strap 23. Another discontinuity exists at connection points between the releasable fasteners 25 and 26 and their respective brassiere wings 21 (e.g., the curve of the line fabric abruptly changes direction at the conjoined fasteners). These limitations interfere with the clothing selection by the woman as tops of delicate material, scoop tops, spaghetti straps or tank tops cannot be worn without exposing the significant size of the brassiere worn by the woman.

The size of the brassiere wings 21 in the prior art brassiere shown in FIG. 2 detract from the comfort of the wearer, particularly when the brassiere is worn over long periods of time. For example, the wearer is much more likely to feel constrained by the sheer sized of the prior art brassiere. A brassiere wing for a 34A may be too small and not provide adequate support for a plus size brassiere such as size 36DD brassiere. Additionally, the excessive coverage of the back and underarm area is likely to produce uncomfortable results, including chafing and excessive perspiration in the covered areas in warm environments or when the wearer is exerting herself.

Likewise, as illustrated in FIG. 2, the material used to construct the brassiere is sufficiently inflexible as to cause the brassiere wings to pull heavily against the wearer's back. This can result in unsightly horizontal seams along the back of the wearer as well as further discomfort for the wearer of the brassiere. A back view of a prior art back-smoothing brassiere 20 has brassiere straps 23, brassiere wings 21, shoulder wing-strap junction 24, and releasable fasteners 25 and 26. In some embodiments, releasable fasteners 25 and 26 includes a hook section 25 and an eye section 26, respectively. The edge line 22 of prior art back-smoothing brassiere 20 descends from the shoulder wing-strap junction 24 to the hook section 25 and eye section 26 in a generally straight line. This substantially straight line makes up a convex portion 22A and concave portion 22B and descent on either side by the edge line 22, and creates a shape similar to a "V" to the back of prior art brassiere 20. This configuration can cover the shoulder blades of the wearer in a manner that will be exposed should the wearer seek to wear clothing that has narrow straps and a partially open back, such as a tank top.

The prior art brassiere 20 can also have an interior (or, "inside") edge 27 of the brassiere strap 23 that descends in a diagonal, generally "S" shaped or reverse "S" shaped line (e.g., including an inflection point wherein the edge of the fabric goes from convex to concave on the back of the wearer) from the top of the shoulder of the wearer towards the shoulder wing-strap junction 24. Such configurations provide a series of discontinuities in the exposed opening of the brassiere on the wearer's back created by edge lines 22 and interior edges 27 of brassiere straps 23. Each of these multiple discontinuities and junctions may cause discomfort for the wearer. Furthermore, the discontinuities can show up as a disturbance under in the fabric of the top.

Moreover, the brassiere wing 21 has a substantially triangular shape. The triangular-shaped brassiere wing 21 provides the additional support required to support fuller bodied women with larger breast size, or persons with breast size that is 34C or above. However, a disadvantage of the triangular-shaped brassiere wing 21 covers more skin, and interferes with wearing under clothes with larger openings in the back and/or smaller shoulder straps such as tank tops, or under tops made of delicate fabrics.

Overall, these prior art configurations result in wearer discomfort, movement constrictions and interference in the wearer's clothing selections. These issues and limitations are exacerbated in back smoothing brassieres for fuller-bodied women.

FIGS. 3-7 illustrate various embodiments and/or portions of a reduced-coverage back-smoothing brassiere 30 that provides back smoothing, adequate support for the wearer's breasts, and is comfortable to wear for longer periods of time. Some of these embodiments comprise two brassiere cups 32 (e.g., a left brassiere cup and right brassiere cup) coupled by a bridge 34. One brassiere wing 31 may extend from the side of each of the brassiere cups 32 (at a first attachment portion) opposite the bridge 34. A brassiere strap 33 (e.g., a left and right brassiere strap) may extend from the upper edge of each brassiere cup 32 upwardly at an acute angle from a top edge 35 of the brassiere wing 31 which is attached to the same brassiere cup 32. The reduced-coverage back-smoothing brassiere 30 has a length 36 which may correspond to a band size (extending at least along the bottom edge of each wing and across the fastening section including elements 42 and 46). The band size is a measurement used to measure brassiere size and reflect a measurement around the wearer's rib cage directly under the breasts. In some embodiments, the length 36 is measured from the hook section 46 to the closest eye of the eye section 42 of the brassiere wing 31. In some embodiments, the length 36 of the reduced-coverage back-smoothing brassiere 30 may represent the shortest distance separating the hook section 46 and the closest eye of the eye section 42 of the brassiere wing 31. In one embodiment, the length 36 of the reduced-coverage back-smoothing brassiere 30 may represent the distance along the fabric line of the reduced-coverage back-smoothing brassiere 30. In various embodiments, the length 36 of the reduced-coverage back-smoothing brassiere 30 is at least 27.5 inches. In some embodiments, the length 36 of the reduced-coverage back-smoothing brassiere 30 is between 27.5 inches and 41.5 inches. For example, a size 36DD reduced-coverage back-smoothing brassiere 30 may have the length 36 of 27⅝ inches.

Figure 3:
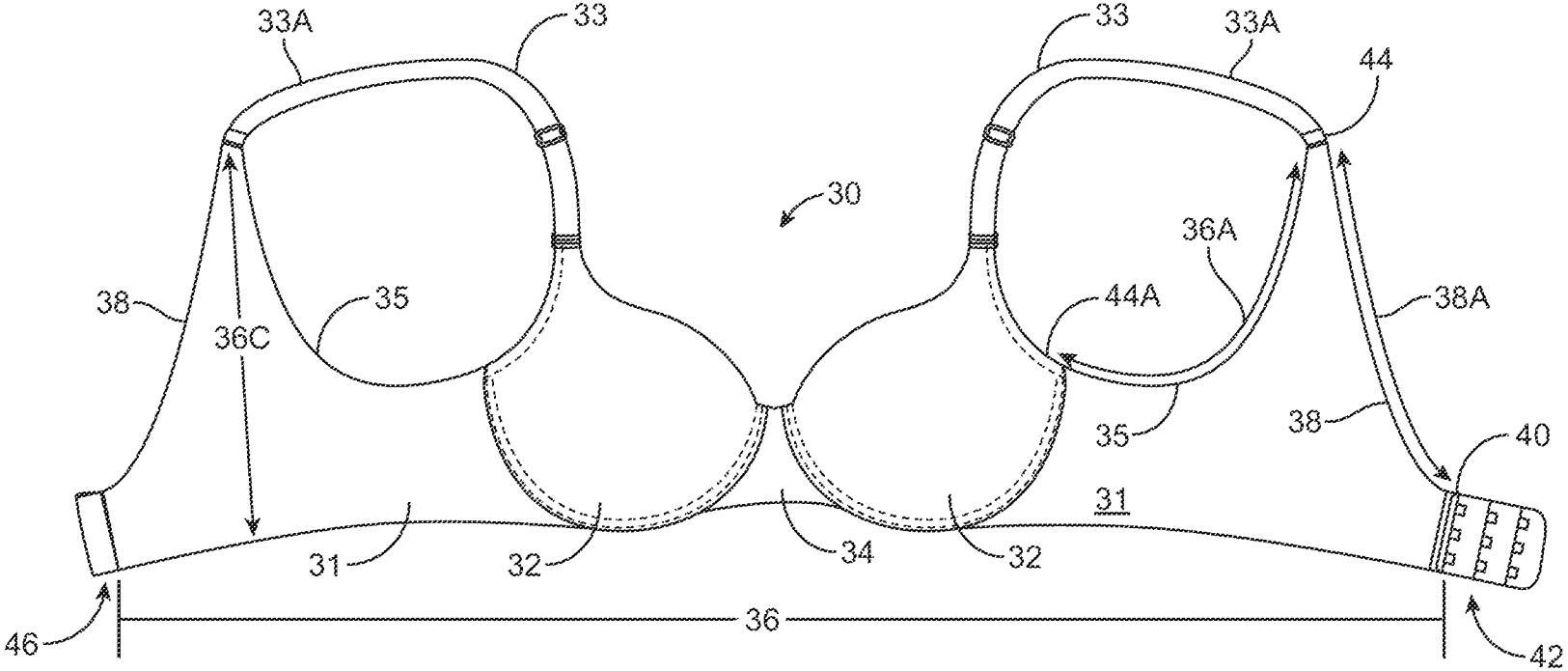
FIG. 3 shows a reduced-coverage back-smoothing brassiere, in accordance with some embodiments of the invention.

Each brassiere wing 31 may include a fastener 40 extending from the distal end of the wing 31. It will be appreciated that any suitable fastener configuration that will releasably secure the distal ends of the two wings 31 together when the reduced-coverage back-smoothing brassiere 30 is worn can be used. As illustrated in FIG. 3, the fasteners 40 can include the configuration of one or more hooks of the hook section 46 on the distal end of one brassiere wing 31 and a matching set of eyes of the eye section 42 on the distal end of the opposite brassiere wing 31. When worn, the hook section 46 may be removably coupled with the matching eye section 42 so that the brassiere fully encircles the upper torso of the wearer. In at least one embodiment, the fasteners 40 include three pairs of vertically-stacked hooks 46 spaced apart laterally to allow the wearer to adjust the diameter of the brassiere for a more precise fit.

In some embodiments, the distal end of the wing 31 (e.g., the fastener portion 40) may have a width that that is smaller than a width (e.g., width 36C) of an opposing end of the wing 31 and/or underarm portion of the wing 31. For example, the end portion connecting to the fastener may have a width that is 20-30% smaller than a length at another portion of the wing 31 (e.g., width 36C).

As illustrated in FIG. 3, each brassiere wing 31 has the top edge (e.g., a first edge) or an underarm edge 35, which extends along the length of the brassiere wing 31 from the brassiere cup 32 to the attachment junction 44 (e.g., attachment portion) between the brassiere wing 31 and the brassiere strap 33. In some embodiments, a length 36A represents the shortest distance separating connecting junctions 44 and 44A. In various embodiments, the length 36A of the reduced-coverage back-smoothing brassiere 30 may represent the distance along the fabric line of the reduced-coverage back-smoothing brassiere 30. In some embodiments, the length 36A of the underarm edge 35 is at least 7⅜ inches. In some embodiments, the length 36A of the underarm edge 35 is between 7⅜ inches and 12⅝ inches. For example, a 36DD sized reduced-coverage back-smoothing brassiere 30 may have the length 36A of 8⅝ inches. In some embodiments, an elastic edging is provided along the top edge 35 of brassiere wing 31 and various edges of the brassiere wing 31. By way of example, these edges are illustrated as edges 35 (a first edge), 37 (a third edge), and 38 (a second edge) in FIG. 3, and can include similarly located edges in other embodiments disclosed herein.

In some embodiments, the edge 38 line may increase and/or transition to a substantially linear edge 38 line. For example, the edge 38 line may continuously increase in slope beginning at the distal end of the wing 31 (e.g., the portion of the wing 31 nearest the fastening portion 40), without flattening or reducing the slope (e.g., until the edge reaches the strap 33).

Figure 4:
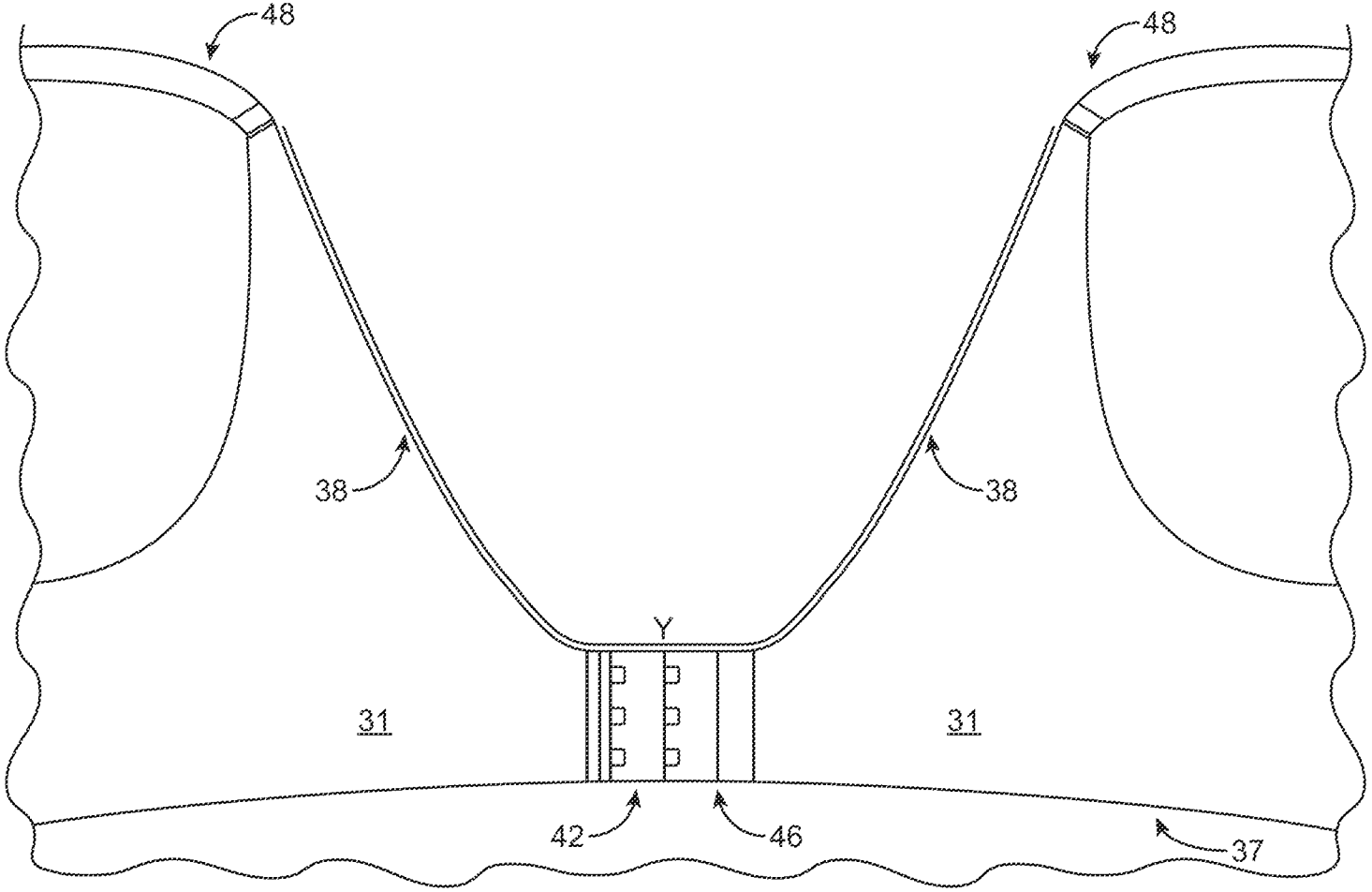
FIG. 4 shows a back portion of a reduced-coverage back-smoothing brassiere, in accordance with some embodiments of the invention.

One or more embodiments of the reduced-coverage back-smoothing brassiere 30 which provides back-smoothing includes a configuration of the portion of the brassiere wings 31 across the wearer's back that minimizes or reduces the brassiere's interference with the wardrobe of the wearer while providing a brassiere that fits comfortably and provides smoothing of the back area of the wearer. For example, at least one embodiment provides a back opening as depicted in FIG. 4 where the interior edges 38 of the brassiere wings 31 that face the center of the wearer's back form an outline that has a smooth (e.g., unbroken) concave curvature, approximately similar to the shape of two parabolas or a catenary, including without limitation a weighted and/or a modified catenary.

In one example, a catenary is the shape a length of material (e.g., a wire, a cord, a chain, a length fabric, and/or the like) will make if only the ends of the length of material are supported. A weighted catenary shape, in an example, is a shape of a catenary where the portions (e.g., links) of the length of material are lighter than the other portions and/or where a weight is applied to certain portions on each side of the center portion(s). Weighted or modified catenary shapes are likely to have a slightly flatter curvature at the center of the shape than a true catenary shape. A modified catenary can further include a catenary where the width of the length of material (e.g., material from which the reduced-coverage back-smoothing brassiere 30 is constructed) is narrower at or near the center of the catenary shape. In various embodiments, the curvature of the edge of fabric of the reduced-coverage back-smoothing brassiere along the back of the wearer may form a catenary shape or a weighted/modified catenary shape.

As used herein, references to a catenary and/or a catenary shape may refer to a geometric shape of the opening between the brassiere straps 33 and the brassiere wings 31 when the brassiere is worn. The reduced-coverage back-smoothing brassiere 30 can be made of any material, but for some or all embodiments a desirable material for the product may encompass a catenary shape that is a fabric having one or more layers.

As will be understood in the mathematical arts, the curve of a catenary can be defined using cartesian coordinates as $$y = a\cosh\left(\frac{x}{a}\right) = \frac{a\left(e^{\frac{x}{a}} + e^{-\frac{x}{a}}\right)}{2}$$

where cosh is the hyperbolic cosine function. In an embodiment of the type of reduced-coverage back-smoothing brassiere 30 illustrated in FIG. 3, the value of a for one or more embodiments of the reduced-coverage back-smoothing brassiere 30 having an interior edge 38 that is substantially a catenary can be between 0.5 and 5, but preferably it is between 1 and 2.

Figure 5:
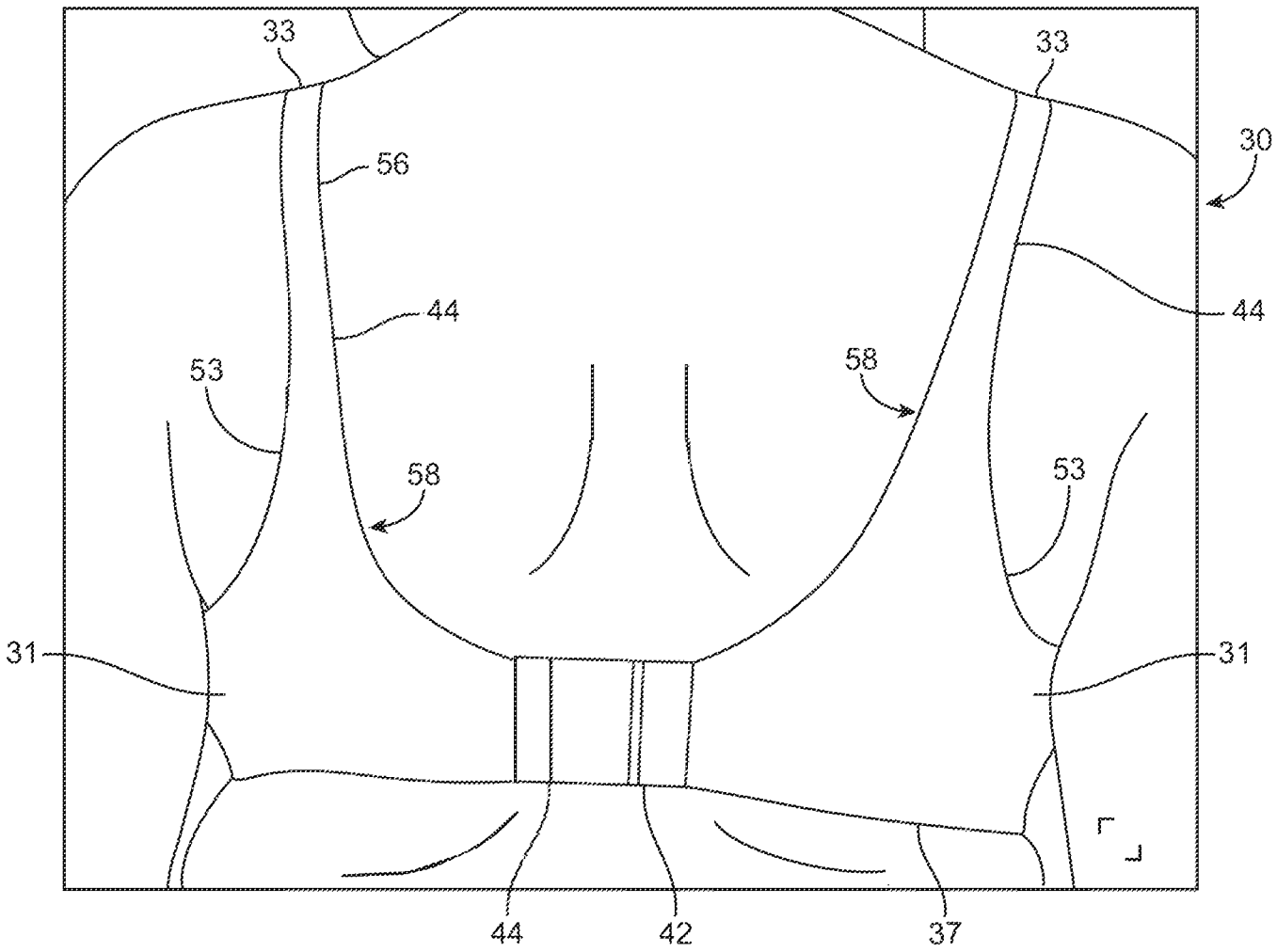
FIG. 5 shows a back portion of a reduced-coverage back-smoothing brassiere, in accordance with some embodiments of the invention.

In configurations where the curvature of the interior edge 38 of the brassiere wing 31 is more approximated by the shape of a weighted catenary, the shape of the interior edge 38 of the brassiere wing 31 can be approximated by the following:

$$y = b\cosh\left(\frac{x}{a}\right) = \frac{b\left(e^{\frac{x}{a}} + e^{-\frac{x}{a}}\right)}{2}$$

Where b is between 1 and 1,000.1 In an embodiment of the type of back-smoothing brassiere illustrated in FIG. 5.

Referring again to FIG. 3, a length 38A may be the length of the interior edge 38. In various embodiments, the length 38A represents the shortest distance separating connecting junction 44 and the releasable fastener 42. In various embodiments, the length 38A of the reduced-coverage back-smoothing brassiere 30 may represent the distance along the interior edge 38 of the reduced-coverage back-smoothing brassiere 30. In some embodiments, a length 38A of the interior edge 38 is at least 5⁵⁄₁₆ inches. In various embodiments, the length 38A is between 5⁵⁄₁₆ inches and 7³⁄₁₆ inches. For example, a size 36DD reduced-coverage back-smoothing brassiere 30 may have the length 36B of 6⅛ inches.

Embodiments are provided wherein the interior edge 38 of the brassiere wings 31 similarly form a substantially continuous concave edge in the area where the releasable fasteners 42 and 46 are attached to the distal ends of the brassiere wings 31. In some embodiments, the substantially continuous concave edge shape is formed by the brassiere wings 31 and an interior edge 33A of the brassiere straps 33. When, for example as illustrated in FIG. 4, the fasteners 42 and 46 in such embodiments are releasably connected, and the brassiere wings 31 encircle the torso of the wearer, the interior edge 38 of the reduced-coverage back-smoothing brassiere 30 is substantially continuous and concave, substantially embodying the shape of a parabola or a catenary. Such continuously concave opening shapes provide the necessary coverage for the wearer's upper back area to provide back-smoothing while not unduly impeding the wear's clothing choices. This also increases the wearer's comfort in wearing the reduced-coverage back-smoothing brassiere 30. Using the continuously curved concave shape allows the reduced-coverage back-smoothing brassiere 30 to have a delicate back line, which allows the wearer greater freedom to wear tank tops and other smaller garments. To the extent the smooth and continuous opening creates a line of the back of a wearer when the wearer is wearing a top made of a delicate fabric, the line may be a more slightly continuous line rather than a discontinuous zig-zag.

Another embodiment of the reduced-coverage back-smoothing brassiere 30 is illustrated in FIG. 5 where the back opening is a defined by a continuous concave curve but is perhaps better approximated by the shape of a weighted or modified catenary. This embodiment includes brassiere wings 31, brassiere straps 33, and a connecting junction 44. Each of the releasable fasteners 42 and 46 is connected to each of the distal ends of the brassiere wings 31. The interior edge 56 of the brassiere strap 33 and interior edge 58 the brassiere wing 31 form a smooth concave curvature as to the spine of the wearer. In the localized area where the fasteners 42 and 44 are located, the curvature of the opening is slightly flatter than the shape of a parabola or an unmodified or unweighted catenary. Still, the opening may be maximized in a manner that allows the wearer to wear a broad range of tops including tank top configurations and tops made of delicate fabrics. The embodiment also provides back smoothing functions by gently directing the wearer's skin away from the opening without creating unsightly bulges or lumps (e.g., based on or assisted by the curvature of the lines of fabric). This continuously concave opening shape provides the necessary coverage for the wearer's upper back area to provide back-smoothing under the wearer's clothes without unnecessarily covering the wearer's back in a way that unduly impedes the wear's clothing choices. This also increases the wearer's comfort in wearing the reduced-coverage back-smoothing brassiere 30. Using the continuously curved concave shape allows the reduced-coverage back-smoothing brassiere 30 to have a delicate back line, which allows the wearer greater freedom to wear tank tops and other smaller garments.

As illustrated in FIG. 5, embodiments includes brassiere straps 33 which connect to the brassiere wings 31 at one or more connecting junctions 44. Embodiments can include connecting junction 44 arranged to be slidable such that the length of the brassiere straps 33 can be adjusted (e.g., as shown in FIG. 3). Alternatively, the connecting junction 44 can be a fixed connection between the brassiere wing 31 and the brassiere strap 33. Regardless of the nature of the connecting junction 44, as illustrated in FIG. 5, various embodiments are arranged such that the interior edge 56 of the brassiere straps 33 and the interior edge 58 of the brassiere wings 31 form a substantially continuous smooth concave line without a significant discontinuity in the curve at the connection junction 44. This continuously concave opening shape provides the necessary coverage for the wearer's upper back area to provide back-smoothing while not unduly impeding the wear's clothing choices. This also increases the wearer's comfort in wearing the reduced-coverage back-smoothing brassiere 30. Using the continuously curved concave shape allows reduced-coverage back-smoothing brassiere 30 to have a delicate back line, which allows the wearer greater freedom to wear tank tops and other smaller garments.

The embodiments illustrated by FIG. 5 include an underarm edge 53 on each of the brassiere wings 31 of the reduced-coverage back-smoothing brassiere 30. One or more such embodiments include an underarm edge 53 which tracks a path just substantially below the underarm of the wearer. Such embodiments can have an underarm edge 53 of the brassiere wing 31 which tracks a path up to 5 inches below the underarm of the wearer and substantially along a path one or more ribs below the top of the wearer's ribcage as the brassiere wing 31 encircles the torso of the wearer as illustrated in FIG. 5. Having an underarm edge 53 so positioned provides back smoothing while improving the comfort of the reduced-coverage back-smoothing brassiere 30 for longer wearing times, particularly for larger sizes of reduced-coverage back-smoothing brassieres 30 for fuller-bodied women. By way of example, the brassiere illustrated in FIG. 5 is a size 38DD reduced-coverage back-smoothing brassiere 30.

Figure 6:
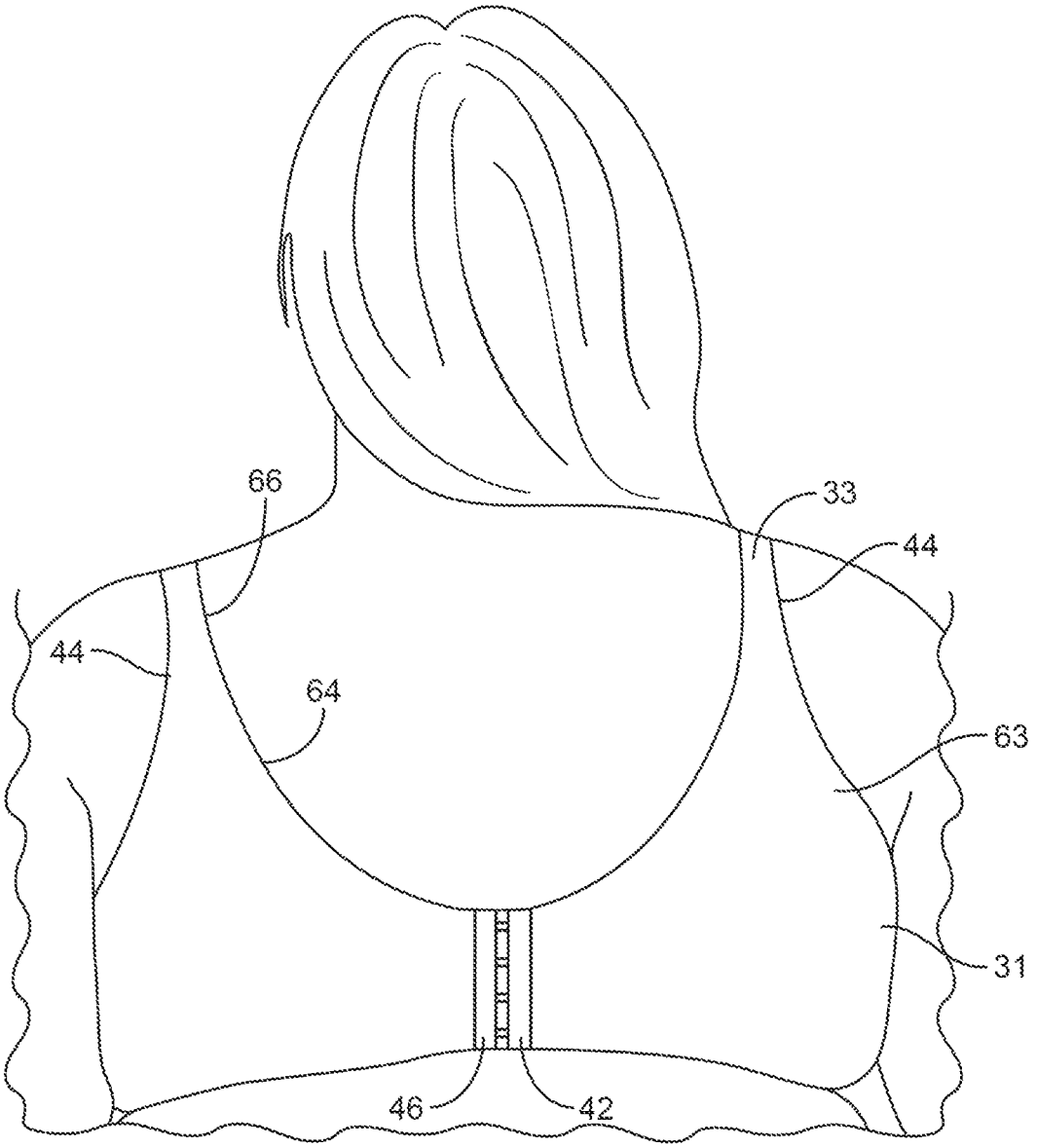
FIG. 6 shows a back portion a reduced-coverage back-smoothing brassiere, in accordance with some embodiments of the invention.

FIG. 6 depicts additional embodiments. In these embodiments, the interior edge 66 of the brassiere straps 33 and the interior edge 64 of the wings 31 form an enlarged opening defined by a smooth concave curve, again substantially in the shape of a catenary. The interior edge 64 at the distal ends of the brassiere wings 31, adjacent to where the fasteners 42 and 46 are located, is only slightly flatter than the curve at the similarly situated interior edge 38 of brassiere wing 31 of the embodiment illustrated in FIG. 4. In these embodiments, the opening on the back of the wearer defined by the curve of the interior edge 64 of the wings 31 is more approximately that of a lightly weighted or slightly modified catenary. This continuously concave opening shape provides the necessary coverage for the wearer's upper back area to provide back-smoothing while maximizing the wear's clothing choices. This also increases the wearer's comfort in wearing the reduced-coverage back-smoothing brassiere 30. Using the continuously curved concave shape allows the reduced-coverage back-smoothing brassiere 30 to have a delicate back line, which allows the wearer greater freedom to wear tank tops and other smaller garments.

The embodiments illustrated in FIG. 6 include an underarm edge 63 on each of the wings 31 of the reduced-coverage back-smoothing brassiere 30. One or more such embodiments include an underarm edge 63 which tracks a path just below the underarm of the wearer and substantially along the top of the wearer's ribcage as the brassiere wing 31 encircles the torso of the wearer as illustrated in FIG. 6. Having an underarm edge 63 so positioned assists with the back smoothing, particularly for larger sizes of reduced-coverage back-smoothing brassieres 30 for fuller-bodied women. By way of example, the brassiere illustrated in FIG. 6 is a size 46DDD brassiere.

The fabric from which the embodiments of the reduced-coverage back-smoothing brassiere 30 are made can be conventional fabrics. Preferably, however, the fabric used for at least the brassiere wings 31 will be a multilayer fabric which includes a power mesh.

Figure 7:
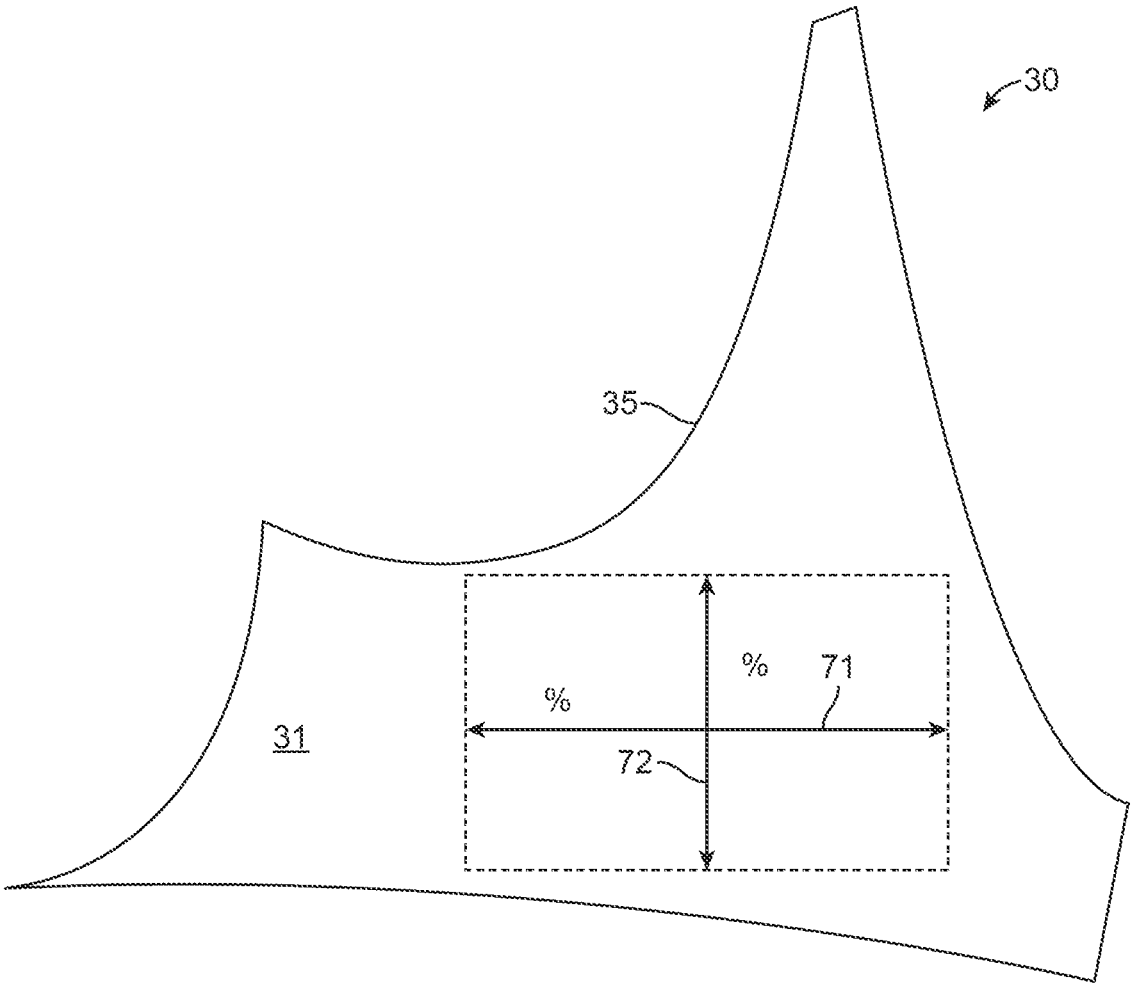
FIG. 7 shows a wing of a reduced-coverage back-smoothing brassiere, in accordance with some embodiments of the invention.

FIG. 7 includes a graphical representation of the a power mesh of the some embodiments of the brassiere wings 31 which include a modulus of elasticity in both the horizontal direction 71 and the vertical direction 72 when the power mesh material is stretched. The modulus of elasticity of the power mesh material in the horizontal and vertical directions is calculated from the percentage the material elongates is each direction when a known force is applied. Fabrics with a higher modulus of elasticity are stiffer and less elastic, whereas fabrics with a lower modulus of elasticity are more flexible and more elastic.

In some embodiments, reduced-coverage back-smoothing brassieres 30 of different sizes may have different modulus of elasticities, the brassiere wings of a smaller brassiere may include a modulus of elasticity that is lower than that of the brassiere wings of a brassiere that is larger. For example, a size 36D reduced-coverage back-smoothing brassiere 30 may have brassiere wings with a modulus of elasticity that is lower than that of a size 48DD reduced-coverage back-smoothing brassiere.

In one embodiment, the brassiere wings of any given size may have areas of varying modulus of elasticity depending on the location of the area. For example, The brassiere wing 31 of the reduced-coverage back-smoothing brassiere 30 of FIG. 4 may have bands of fabric with varying elasticity. For example, an area of the brassiere wing 31 closer to edge 37 may have a higher modulus of elasticity than an area of the brassiere wing 31 closer to the connecting junction 28.

In some embodiments, the material used to construct at least the brassiere wings 31 is a two layer material having an outer layer that is a microfiber and an inner layer that is a power mesh. The outer layer may be the fabric layer is the furthest from the body of the wearer, while the inner layer may be the fabric layer closest to the body of the wearer. In the various embodiments, the power mesh material of the reduced-coverage back-smoothing brassiere 30 is breathable and lightweight. Additionally, the power mesh is one of only two total layers of material (e.g., with a soft, microfiber outer-covering) and is not sandwiched between solid layers of material as is typically present in prior art brassieres that provide back-smoothing. In some embodiments of the reduced-coverage back-smoothing brassiere 30 thus feel more comfortable to the wearer.

Typically, skin on a wearer's back is softer and can be gently shaped, contained and covered with fabrics with lower moduli of elasticity than is typically used in customary brassieres that provide back-smoothing. The power mesh used in at least the brassiere wings 31 of some embodiments of the reduced-coverage back-smoothing brassiere 30 with back smoothing has a lower modulus of elasticity in both the vertical and horizontal directions than fabrics traditionally used in a brassiere that provides back smoothing. By way of example, the power mesh used in some embodiments used a power mesh with the characteristics of the Best Pacific Mills Power Mesh, Article Number 34140, or other commercially available power meshes with similar characteristics.

The microfiber outer layer of one or more embodiments can include the material manufactured by Best Pacific Mills Power Mesh, Article Number EJ0036MS1, or other commercially available microfiber fabrics with similar characteristics. Brassiere cups 32 are preferably manufactured with the same microfiber material used in the brassiere wings 31. These examples of materials used are merely exemplary, and not limiting of any embodiment to a particular material, such that other types of materials with similar characteristics may be utilized.

Figure 8:
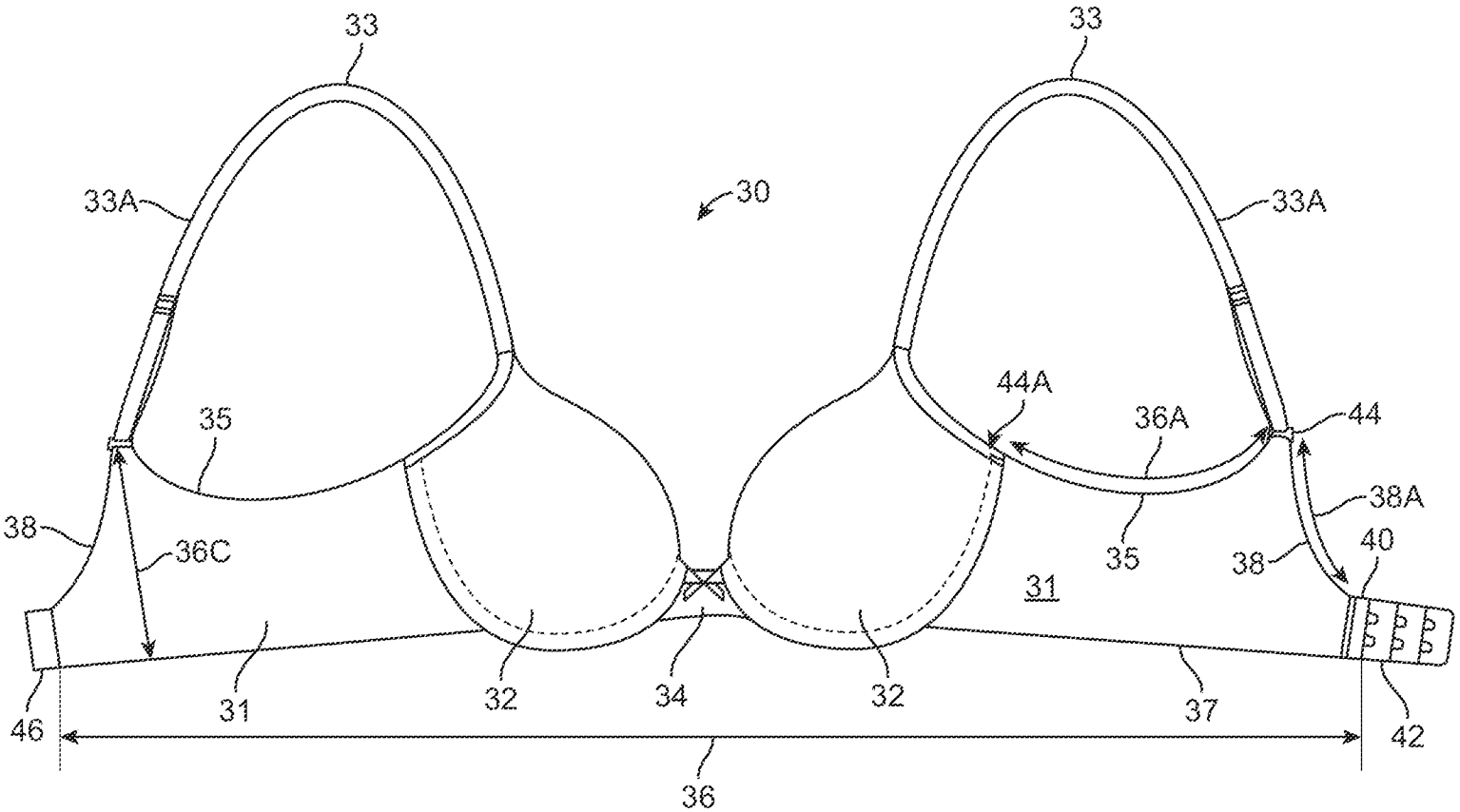
FIG. 8 shows a reduced-coverage back-smoothing brassiere, in accordance with some embodiments of the invention.

FIG. 8 depicts another embodiment of a reduced-coverage back-smoothing brassiere 30.

Figure 9:
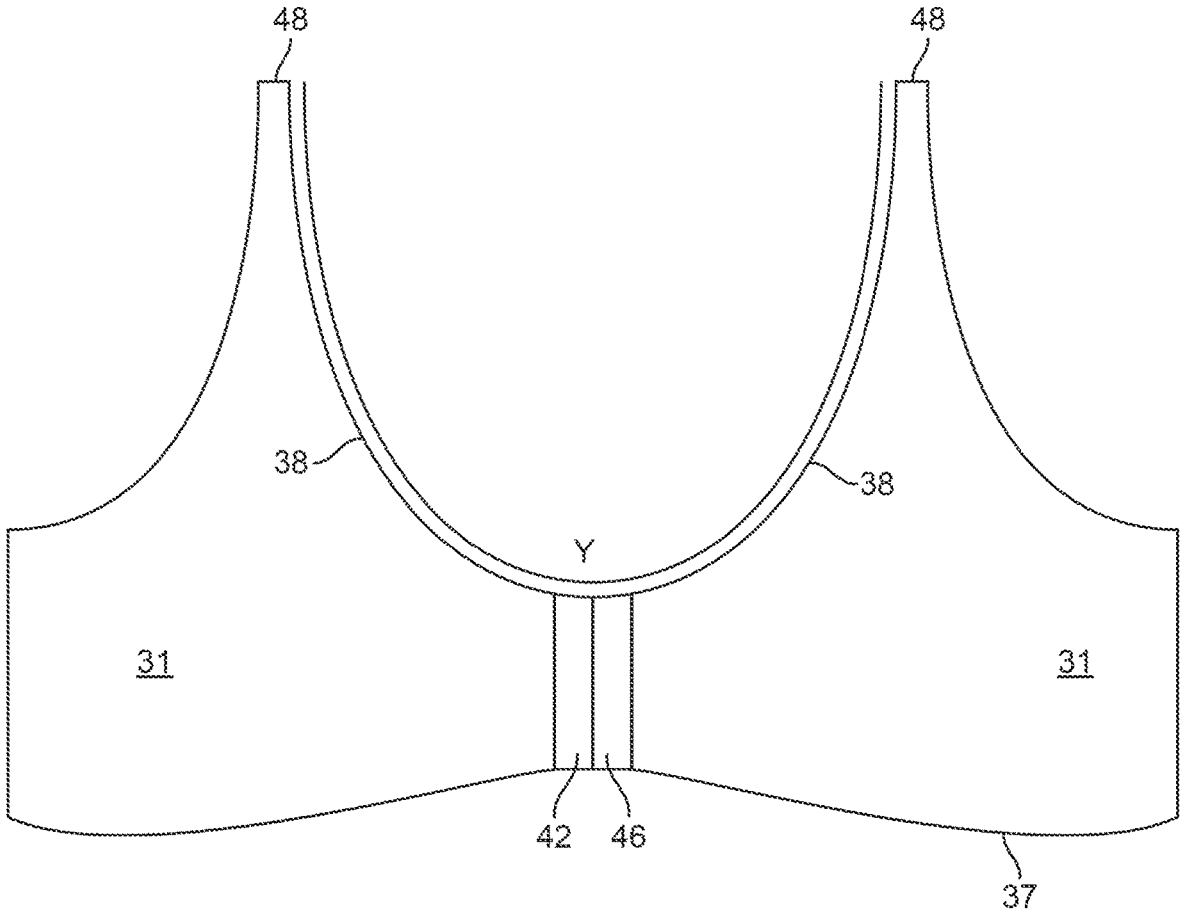
FIG. 9 shows a back portion of a reduced-coverage back-smoothing brassiere, in accordance with some embodiments of the invention.
Figure 10G:
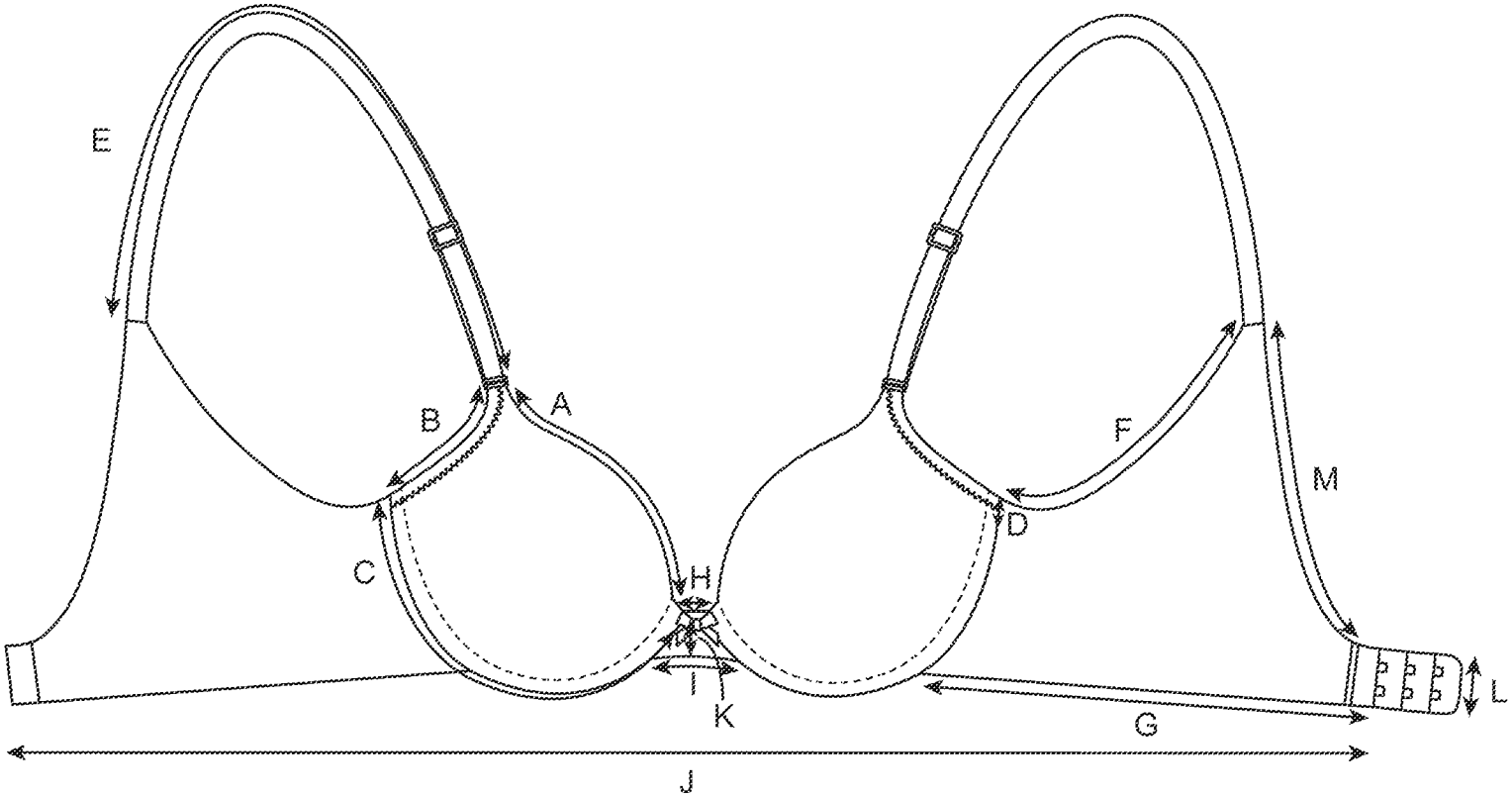
Figure 11H:
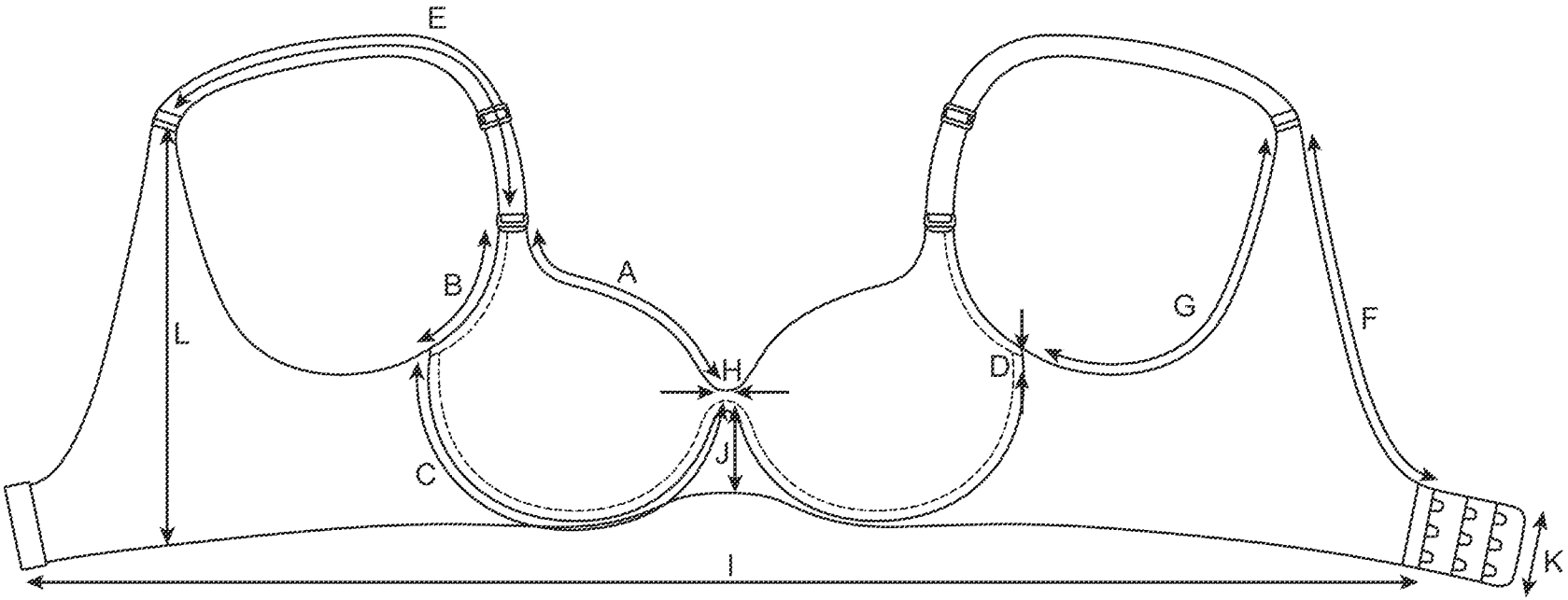

FIG. 9 shows a back portion of another embodiment of a reduced-coverage back-smoothing brassiere 30.

Example characteristics of the reduced-coverage back-smoothing brassiere 30 of FIG. 8 (e.g., a reduced-coverage back-smoothing "push-up plunge" brassiere) are shown in FIGS. 10A-10G. Example characteristics of the reduced-coverage back-smoothing brassiere 30 of FIG. 3 (e.g., a reduced-coverage back-smoothing "t-shirt" brassiere) are shown in FIGS. 11A-11H.

Other alterations and modifications of embodiments discussed herein will likewise become apparent to those of ordinary skill in the art upon reading the present disclosure, and it is intended that the scope of the embodiments disclosed herein be limited only by the broadest interpretation of the appended claims to which the inventors are legally entitled.

The invention claimed is:

1. A reduced-coverage back-smoothing brassiere for a fuller-bodied woman having a bra size of 34C or larger, the reduced-coverage back-smoothing brassiere comprising:

a right brassiere cup and a left brassiere cup;

a left brassiere wing and a right brassiere wing, the left brassiere wing including a left cup attachment portion, a left fastener attachment portion, a left top wing edge, a left underarm edge, and a left bottom edge, the right brassiere wing including a right cup attachment portion, a right fastener attachment portion, a right top wing edge, a right underarm edge, and a right bottom edge, the left cup attachment portion being coupled to at least a portion of the left brassiere cup, the right cup attachment portion being coupled to at least a portion of the right brassiere cup, the left fastener attachment portion being coupled to the left cup attachment portion and to a left fastener section, the right fastener attachment portion being coupled to the right cup attachment portion and to a right fastener section, each of the left top wing edge, the left underarm edge, the right top wing edge and the right underarm edge comprising an elastic edging; and a right brassiere strap and a left brassiere strap, the right brassiere strap including a right strap front portion opposite a right strap back portion as well as a right strap interior edge opposite a right strap exterior edge, the left brassiere strap including a left strap front portion opposite a left strap back portion as well as a left strap interior edge opposite a left strap exterior edge, the right strap back portion being coupled to the right brassiere wing between the right cup attachment portion and the right fastener attachment portion, the left strap back portion being coupled to the left brassiere wing between the left cup attachment portion and the left fastener attachment portion, the right strap front portion being coupled to the right brassiere cup, the left strap front portion being coupled to the left brassiere cup, the left top wing edge, the right top wing edge, the left strap interior edge of the left strap back portion, and the right strap interior edge of the right strap back portion forming a continuously catenary curve when worn, the continuously catenary curve including no vertical section, each of the left underarm edge and the right underarm edge forming a continuous curve when worn, each of the left brassiere wing and the right brassiere wing including at least two layers of fabric, at least one of the layers including a power mesh fabric, a left first area of the power mesh fabric of the left brassiere wing closer to the left top wing edge having a lower modulus of elasticity than a left second area of the power mesh fabric of the left brassiere wing closer to the left bottom edge, a right first area of the power mesh fabric of the right brassiere wing closer to the right top wing edge having a lower modulus of elasticity than a right second area of the power mesh fabric of the right brassiere wing closer to the right bottom edge.

2. The reduced-coverage back-smoothing brassiere of claim 1, wherein one of the at least two layers of fabric includes microfiber.

3. The reduced-coverage back-smoothing brassiere of claim 1, wherein a left top edge of the left fastening section and a right top edge of the right fastening section form part of the continuously catenary curve.

* * * * *